US011524758B2

(12) United States Patent
Borich et al.

(10) Patent No.: US 11,524,758 B2
(45) Date of Patent: Dec. 13, 2022

(54) UNIVERSAL MOTORIZED PERSONAL WATERCRAFT PROPULSION MOUNTING SYSTEM

(71) Applicant: Detekt Biomedical, LLC, Austin, TX (US)

(72) Inventors: Damon Vincent Borich, Austin, TX (US); Karen Borich, Austin, TX (US); Andrea Grbavac, Austin, TX (US); Zwckxally Obregon, Cedar Creek, TX (US)

(73) Assignee: Defekt Biomedical, LLC, Austin, TX (US)

( * ) Notice: Subject to any disclaimer, the term of this patent is extended or adjusted under 35 U.S.C. 154(b) by 332 days.

(21) Appl. No.: 16/904,094

(22) Filed: Jun. 17, 2020

(65) Prior Publication Data

US 2020/0317313 A1 Oct. 8, 2020

Related U.S. Application Data

(62) Division of application No. 16/427,397, filed on May 31, 2019, now Pat. No. 10,773,781.

(60) Provisional application No. 62/680,999, filed on Jun. 5, 2018.

(51) Int. Cl.

| | |
|---|---|
| ***B63H 5/125*** | (2006.01) |
| ***B63H 1/14*** | (2006.01) |
| ***B63H 21/17*** | (2006.01) |
| ***B63H 20/02*** | (2006.01) |

(Continued)

(52) U.S. Cl.

CPC ..... *B63H 5/125* (2013.01); *B63H 1/14* (2013.01); *B63H 20/02* (2013.01); *B63H 21/17* (2013.01); *B63B 32/10* (2020.02); *B63B 34/26* (2020.02)

(58) Field of Classification Search

CPC ..... B63H 5/125; B63H 1/14; B63H 20/02; B63H 21/17; B63B 34/26; B63B 32/10

See application file for complete search history.

(56) References Cited

U.S. PATENT DOCUMENTS

| | | | | |
|---|---|---|---|---|
| 4,049,333 A * | 9/1977 | Wallace | ..... | H01R 11/30 211/DIG. 1 |
| 4,279,745 A * | 7/1981 | Haase | ..... | A47L 13/41 209/215 |
| 6,136,610 A | 10/2000 | Polito et al. | | |

(Continued)

OTHER PUBLICATIONS

International Search Report and Written Opinion, Application No. PCT/US2015/054680, dated Dec. 29, 2015, 10 pages.

(Continued)

*Primary Examiner* — Stephen P Avila

(74) *Attorney, Agent, or Firm* — Kowert, Hood, Munyon, Rankin & Goetzel, PC; Gareth M. Sampson

(57) ABSTRACT

A paddle assistance and propulsion system for use with personal watercraft is disclosed. The paddle assistance and propulsion system may include different mounting techniques that allow a propulsion device (e.g., a motor) to be coupled to various types of personal watercraft. Some mounting techniques may include the use of magnets to couple a motor-side mount to a boat-side mount. The paddle assistance and propulsion system may also utilize a variety of sensors in combination with control systems to provide various types of paddle assistance and different types of paddle assistance modes for the user of the personal watercraft.

16 Claims, 26 Drawing Sheets

(51) Int. Cl.
*B63B 32/10* (2020.01)
*B63B 34/26* (2020.01)

(56) References Cited

U.S. PATENT DOCUMENTS

| | | | | |
|---|---|---|---|---|
| 6,180,409 | B1 | 1/2001 | Howard, III et al. | |
| 6,528,323 | B1 | 3/2003 | Thayer et al. | |
| 7,022,517 | B1 | 4/2006 | McDevitt | |
| 7,027,146 | B1 | 4/2006 | Borich et al. | |
| 7,267,799 | B1 | 9/2007 | Borich et al. | |
| 7,365,849 | B2 | 4/2008 | Yao et al. | |
| 7,444,005 | B2 | 10/2008 | Bachur, Jr. et al. | |
| 7,632,460 | B2 | 12/2009 | Catt et al. | |
| 7,803,322 | B2 | 9/2010 | Borich | |
| 7,939,342 | B2 | 5/2011 | Song et al. | |
| 8,367,013 | B2 | 2/2013 | Kaylor et al. | |
| 9,116,147 | B2 | 8/2015 | Anslyn | |
| 9,833,783 | B1 | 12/2017 | Klein | |
| D829,337 | S | 9/2018 | Klein | |
| 10,132,802 | B2 | 11/2018 | Ehrenkranz | |
| 10,252,134 | B2 | 4/2019 | Postelnik | |
| 10,625,828 | B1 * | 4/2020 | Sharon | B63B 32/70 |
| 11,367,425 | B2 * | 6/2022 | Antao | G10K 11/006 |
| 2003/0119203 | A1 | 6/2003 | Wei et al. | |
| 2006/0175996 | A1 | 8/2006 | Tether | |
| 2007/0231922 | A1 | 10/2007 | Petruno et al. | |
| 2009/0269765 | A1 | 10/2009 | Anslyn | |
| 2010/0254581 | A1 | 10/2010 | Neeser | |
| 2011/0104963 | A1 | 5/2011 | Ellis | |
| 2011/0211982 | A1 * | 9/2011 | Marks | F04D 13/0666 417/420 |
| 2011/0217205 | A1 | 9/2011 | Peeters | |
| 2012/0083044 | A1 | 4/2012 | Sturman et al. | |
| 2012/0300211 | A1 | 11/2012 | Wang | |
| 2013/0035010 | A1 | 2/2013 | Boukas | |
| 2013/0244339 | A1 | 9/2013 | Ehrenkranz et al. | |
| 2016/0059946 | A1 | 3/2016 | Chen | |
| 2016/0103075 | A1 | 4/2016 | Borich | |
| 2016/0223536 | A1 | 8/2016 | Johnson et al. | |
| 2016/0325815 | A1 | 11/2016 | Nikmanesh | |
| 2017/0297661 | A1 | 10/2017 | Railey | |
| 2018/0001986 | A1 | 1/2018 | Nutz | |
| 2018/0099734 | A1 | 4/2018 | Schibli | |
| 2018/0162506 | A1 | 6/2018 | Ajello | |
| 2018/0180552 | A1 | 6/2018 | Klein | |
| 2019/0106190 | A1 | 4/2019 | Schibli | |
| 2019/0302009 | A1 | 10/2019 | Borich | |

OTHER PUBLICATIONS

International Preliminary Report on Patentability, Application No. PCT/US2015/054680, dated Apr. 20, 2017, 7 pages.

Wavejet Propulsion, www.wavejet.com/about/, available as of Apr. 25, 2019, pages not printable.

* cited by examiner

UNIVERSAL MOTORIZED PERSONAL WATERCRAFT PROPULSION MOUNTING SYSTEM

PRIORITY CLAIM

This patent is a divisional of U.S. patent application Ser. No. 16/427,397 to Borich et al., entitled "UNIVERSAL MOTORIZED PERSONAL WATERCRAFT PROPULSION ASSISTANCE & TRAINING DEVICE", filed May 31, 2019, which claims priority to U.S. Provisional Patent Application No. 62/680,999 to Borich et al., entitled "UNIVERSAL MOTORIZED WATERCRAFT PADDLE ASSISTANCE & PROPULSION DEVICE", filed Jun. 5, 2018, each of which are incorporated by reference in their entirety.

BACKGROUND

1. Technical Field

Embodiments described herein relate to systems and methods for providing propulsion assistance for paddling personal watercraft. Embodiments described herein also relate to systems and methods for mounting a propulsion device to a personal watercraft.

2. Description of Related Art

With the rising global trend of both personal and business-tourism use of recreational paddle sports including, but not limited to, kayaking, canoeing, and stand up paddle boarding (SUP), sales of personal watercraft and their associated equipment have been steadily increasing in recent years. Aside from being a way for individuals to enjoy outdoor recreation, kayaks and similar watercraft such as canoes are used due to their simplicity, portability, compact nature, and ability to access water regions that may otherwise be difficult to access. Personal watercraft allow individuals to explore the outdoors while being active and can be used for both extreme sport, exercise, recreation, and/or leisure. Regardless of the specific purpose that the watercraft are utilized for, there are several universal challenges that often arise when individuals are out on the water. People may, for example, encounter the challenge of navigating to distant, difficult-to-reach water regions, which may cause physical overexertion and/or physical exhaustion after hours of rigorous paddling (or other manual propulsion) in tumultuous waters. Often, individuals may not explore as much of the waterscape as they may desire to due to the concern of not having the energy to arrive back to shore. In the case that weather conditions become less than ideal, rain or wind can make it increasingly difficult for people to arrive to their destinations safely via manual paddling/propulsion alone.

Thus, there is a need for to provide electronic paddle-assistance via versatile and easy-to-use and mount portable electric propulsion systems (e.g., a universal motorized watercraft paddle assistance and propulsion device). Different mounting methods may be used to attach the device to different types of watercraft (e.g., watercraft with different hull shapes and/or different hull features). Such systems, and associated methods, may provide flexible and customizable mount configurations that allow people to use various types of watercraft with the propulsion system. Such systems may provide a high degree of portability, flexibility, and ease of use while allowing people to explore more water regions while having the confidence that they can safely arrive back to shore even after reaching the point of exhaustion.

SUMMARY

In certain embodiments, a portable electronically controlled propulsion system for a watercraft includes a propulsion device configured to be attached to the hull of the watercraft with a hinge. The propulsion device may be capable of being rotated on the hinge between a deployed position and an undeployed position. One or more sensors coupled to the propulsion device may be capable of assessing at least an angle or position state of the hinge, force on the hinge, thrust output of the propulsion device, and water speed of the propulsion device. A programmable propulsion controller may be capable of receiving data from the sensors. The programmable propulsion controller may electronically control the propulsion device to provide propulsion assistance for the watercraft. The programmable propulsion controller may be capable of determining at least one mode of propulsion assistance for the watercraft based on the data received from the sensors and at least one user input.

In certain embodiments, a mounting system for coupling a propulsion device to a watercraft includes a first mounting component configured to be attached to the hull of the watercraft with an adhesive. The first mounting component may include one or more first magnets. A second mounting component may be configured to be attached to the propulsion device with at least one fastener. The second mounting component may include one or more second magnets. The first magnets may be arranged in the first mounting component and the second magnets may be arranged in the second mounting component such that the second 2 magnets are attracted to the first magnets when the second mounting component is positioned in proximity to the first mounting component, the second mounting component thereby being coupled to the first mounting component by the attraction between the second magnets and the first magnets.

BRIEF DESCRIPTION OF THE DRAWINGS

Features and advantages of the methods and apparatus of the embodiments described in this disclosure will be more fully appreciated by reference to the following detailed description of presently preferred but nonetheless illustrative embodiments in accordance with the embodiments described in this disclosure when taken in conjunction with the accompanying drawings in which.

Figure 1:
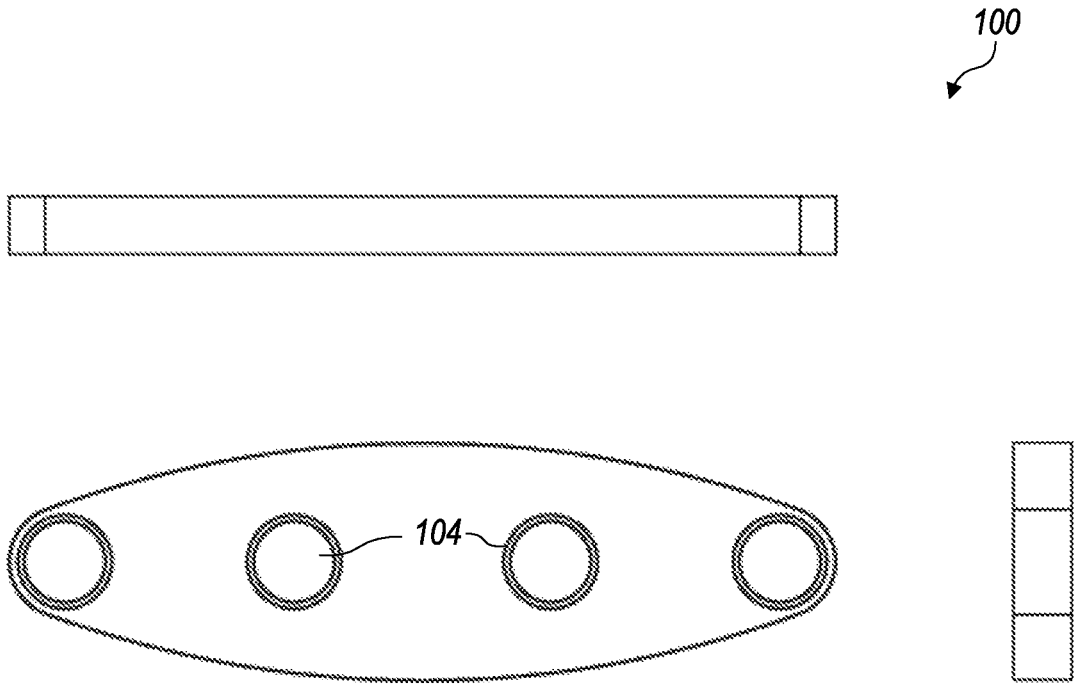
FIG. 1 depicts side-, bottom-, and end-view representations of an embodiment of a boat-side mount.

While embodiments described in this disclosure may be susceptible to various modifications and alternative forms, specific embodiments thereof are shown by way of example in the drawings and will herein be described in detail. It should be understood, however, that the drawings and detailed description thereto are not intended to limit the embodiments to the particular form disclosed, but on the contrary, the intention is to cover all modifications, equivalents and alternatives falling within the spirit and scope of the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

Personal watercraft may include, but not be limited to, kayaks, canoes, stand up paddle (SUP) boards, and surfboards. There are multiple non-motorized ways to propel a personal watercraft device including, but not limited to, traditional paddles, oars, pedal operated paddle wheels, pedal propeller drives (e.g., Propel Drive from Native Watercraft (Fletcher, N.C.)) and pedal operated fin drives (e.g., MirageDrive systems from Hobie Cat Company (Oceanside, Calif.)). In the context of this patent, all of these user-initiated events with the intent to provide forward or reverse motion may be referred to as "paddle strokes". Subsequently, any additional thrust provided by an electronic propulsion system described herein may be referred to as "paddle-assistance".

Various embodiments of magnet-based mounting systems for mounting a propulsion device (e.g., a motor) to a personal watercraft are described herein. Certain embodiments describe attaching a propulsion device to a mount (e.g., a motor mount) where the mount is magnetic and fits with (e.g., couples with) a magnetic mount attached to a personal watercraft (e.g., a boat-side mount). The propulsion device may be used for motorized (e.g., electronic) paddle assistance of the personal watercraft (e.g., to provide electronic propulsion assistance to a user attempting to paddle the watercraft).

Boat-side mounts may have various configurations as described herein based on the style (e.g., hull shape) of the personal watercraft to which the mount is attached. Various embodiments of the boat-side mounts and motor mounts described herein are designed to prevent the motor from slipping out of the mount while the watercraft is in motion. For example, a series of magnets, as described herein, may be use to secure the motor mount to the boat-side mount to provide simple and secure mounting while also allowing mounting compatibility for many different types of watercraft (including watercraft designed for different types of functions such as stability, speed, and/or inflatability).

While the various embodiments described herein provide specific systems and methods for mounting the propulsion device to the personal watercraft, it is to be understood that other embodiments may be contemplated that include combinations of features from the various embodiments described herein. For example, some of the embodiments described herein may be configured for specific types of personal watercraft (e.g., a particular hull shape, material, or design). Features from such embodiments may, however, be useful for other types of personal watercraft described herein or possibly other types of watercraft not explicitly contemplated herein. In some instances, features from multiple embodiments described herein may be combined for a particular type of personal watercraft (either described herein or otherwise contemplated).

Figure 2:
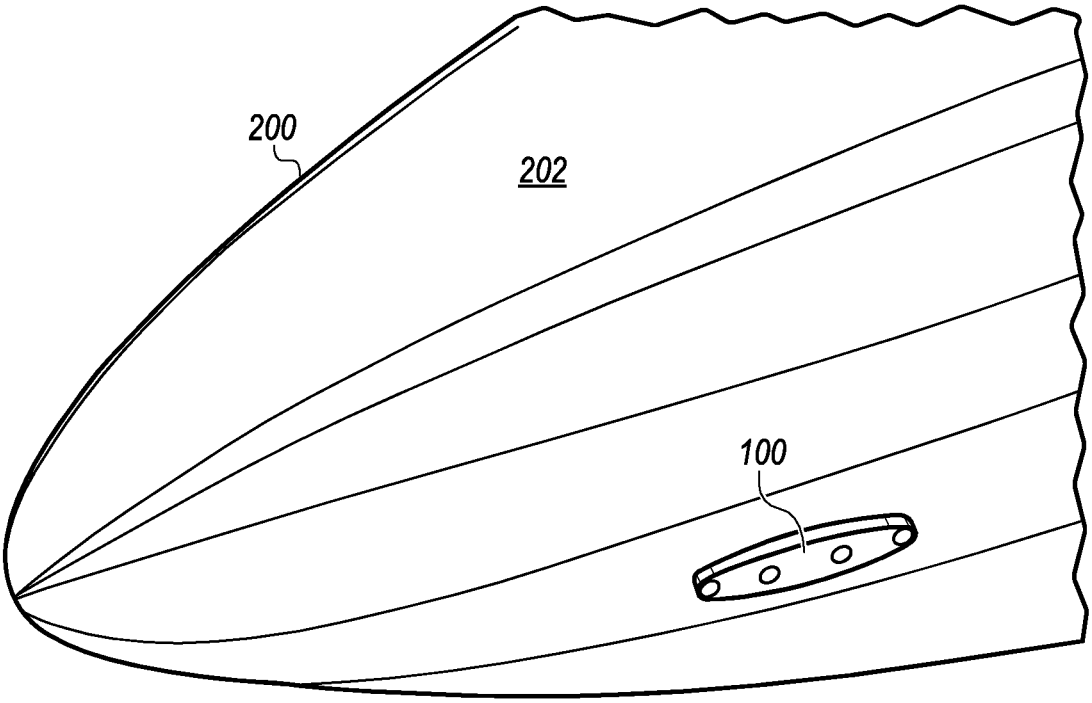
FIG. 2 depicts a perspective representation of an embodiment of a mount attached to a watercraft.

FIG. 1 depicts side-, bottom-, and end-view representations of an embodiment of boat-side mount 100. Mount 100 may be mounted to standard personal watercraft such as watercraft having, for example, a straight hull marked by a flat middle plane. FIG. 2 depicts a perspective representation of an embodiment of mount 100 attached to watercraft 200. As shown in FIG. 2, mount 100 may be attached a flat portion of hull 202 of watercraft 200.

Figure 3:
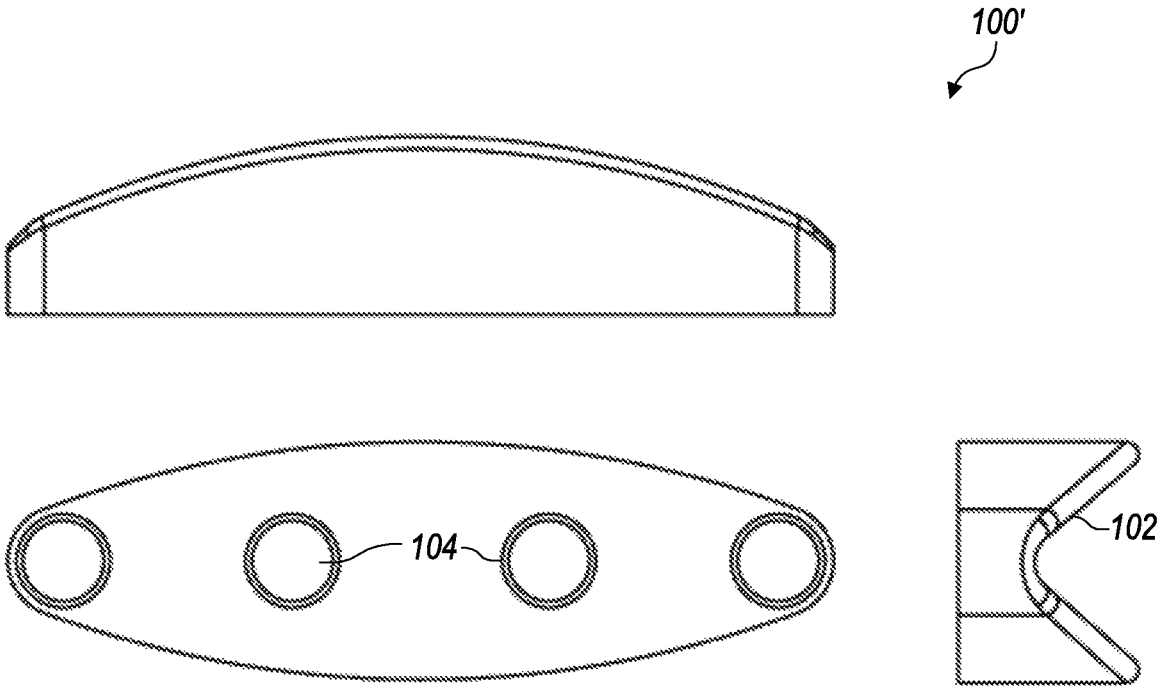
FIG. 3 depicts side-, bottom-, and end-view representations of another embodiment of a boat-side mount.

FIG. 3 depicts side-, bottom-, and end-view representations of an embodiment of boat-side mount 100'. Mount 100' may be mounted to personal watercraft having, for example, a v-shaped hull or hull with a portion of the hull being v-shaped. As shown in the end-view representation, mount 100' may include recess 102. Recess 102 may be shaped (e.g., molded) to match the shape of the bottom point of the hull of the watercraft (e.g., the v-shaped portion of the hull). The shape of recess 102 allows the edge of the watercraft to rest inside mount 100' while the opposite side of the mount is used for attachment to a motor-side mount (described herein).

Figure 4:
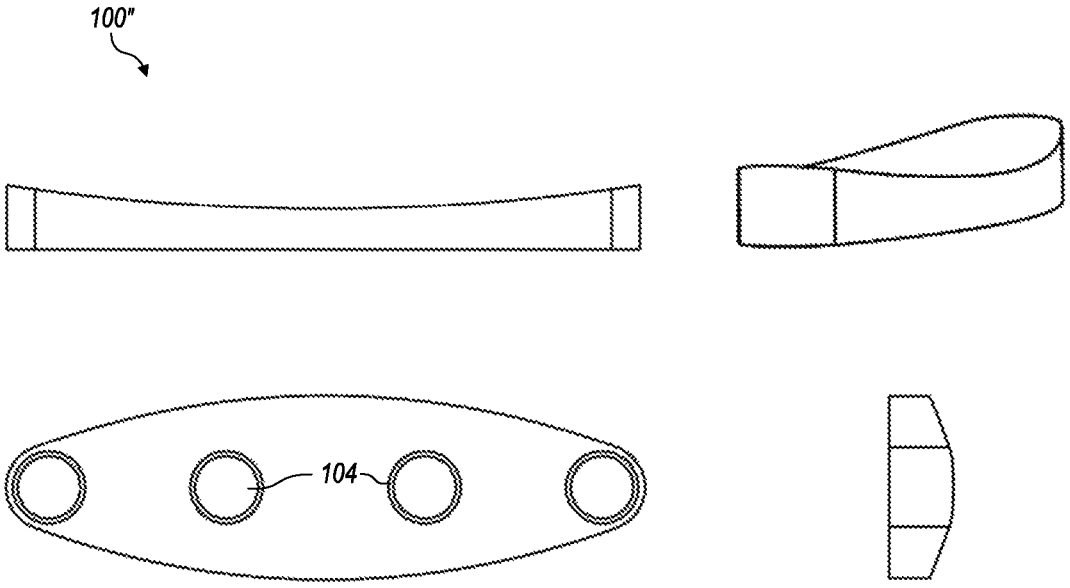
FIG. 4 depicts side-, bottom-, and end-view representations along with a perspective view representation of an embodiment of a boat-side mount.

FIG. 4 depicts side-, bottom-, and end-view representations along with a perspective view representation of an embodiment of boat-side mount 100". Mount 100" may be mounted to personal watercraft having, for example, rounded hull (e.g., the bottom of the hull is rounded). As shown in the side-view and perspective view representations, mount 100" may have an upper surface shaped (e.g., molded) to match the curvature of the bottom point of the hull of the watercraft (e.g., the rounded portion of the hull). For example, mount 100" may have a convex curvature to match the concave curvature of the bottom of the hull.

In certain embodiments, the boat-side mount (e.g., mount 100, mount 100', and/or mount 100") is 3-D printed on demand based on the form factor of the watercraft that the mount will be attached to. In certain embodiments, the boat-side mount (e.g., mount 100, mount 100', and/or mount 100") is coupled (e.g., attached) to the hull (e.g., hull 202) using a semi-permanent attachment method. The semi-permanent attachment method may, for example, include attachment methods that prevent unwanted removal of the boat-side mount (e.g., the mount is not removed unless the user intends to remove the mount from the hull).

In some embodiments, the boat-side mount is attached to the hull using standard silicone caulk. For example, a user may place a layer of silicone in the shape of the boat-side mount on the hull (e.g., at a flat back end of a kayak). The boat-side mount may then be pressed onto the silicone layer and extra adhesive can be removed. The boat-side mount may be held in place using external force until the caulk cures and holds the boat-side mount in place on the hull. Using caulk may provide a more permanent attachment for the boat-side mount.

In some embodiments, a very high bond adhesive (such as 3M™ VHB™ adhesive) may be used along with an adhesion promoter. In such embodiments, the surface of the hull may be prepped with the adhesion promoter and then the very high bond adhesive may be applied. The boat-side mount may then be pressed onto the hull and the adhesive may be allowed to cure.

In some embodiments, a waterproof suction attachment may be used to attached the boat-side mount to the hull. This may be a less permanent solution than either caulk or very high bond adhesive. Using the waterproof suction attachment may be useful in situations where less permanent attachment is desired (such as for use with rental boats). The waterproof suction attachment may include a lever to suction the attachment to the hull. The lever may later be operated to release suction and remove the boat-side mount from the hull.

In certain embodiments, the boat-side mount (e.g., mount 100, mount 100', or mount 100") includes a series of magnets on a bottom-side of the mount (e.g., on the side of the mount opposite the side attached to the hull). FIGS. 1, 3, and 4 depict magnets 104 on the bottom-sides of mounts 100, 100', and 100", respectively. Magnets 104 may be a series of magnets in a line horizontally across mount 100. For example, magnets 104 may be a series of magnets aligned along a line (e.g., a centerline) of the boat-side mount. In certain embodiments, magnets 104 includes four magnets in a line horizontally across mount 100. Aligning magnets 104 along a line may provide alignment (e.g., proper orientation) for a propulsion device when the propulsion device is coupled to the boat-side mount using a motor-side mount, as described below.

In certain embodiments, a motor-side mount is designed to couple to (e.g., mate) a boat-side mount (e.g., mount 100, mount 100', or mount 100" described above). The motor-side mount may be coupled to or attached to a propulsion device (e.g., a motor). Thus, coupling the motor-side mount to the boat-side mount (which is attached to the hull of the personal watercraft) couples the propulsion device to the watercraft. In some embodiments, the motor-side mount is a single mount that is compatible with any of the above-described boat-side mounts (e.g., the motor-side mount is universally compatible with the described boat-side mounts).

Figure 5:
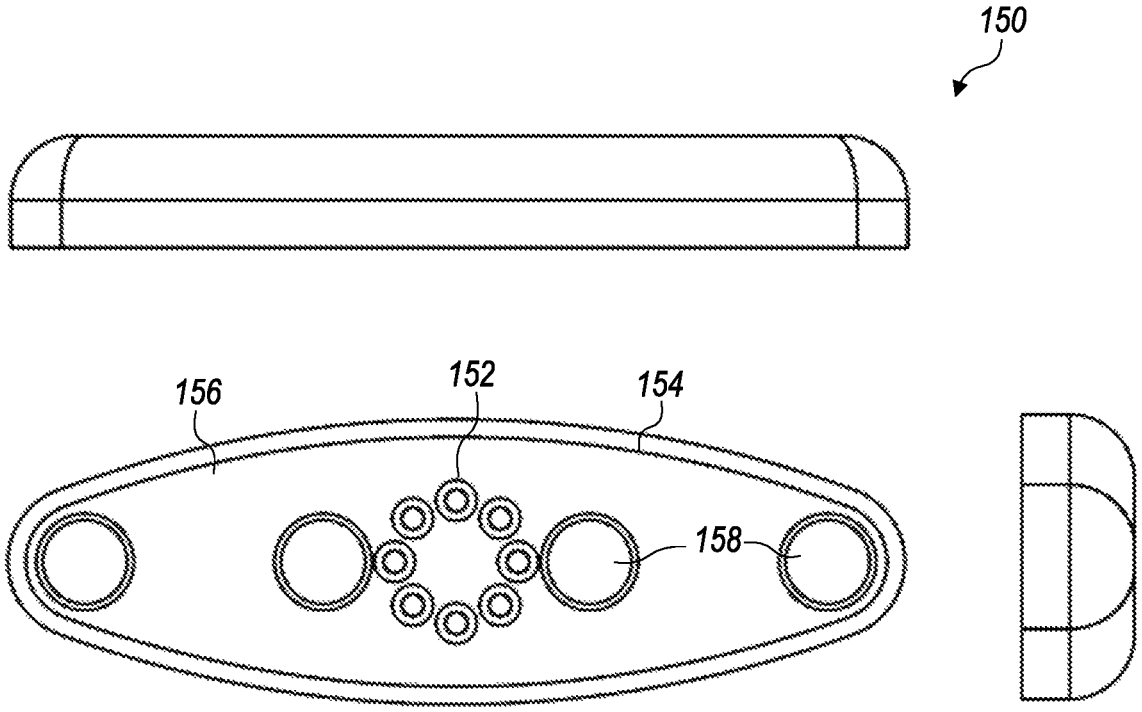
FIG. 5 depicts side-, bottom-, and end-view representations of an embodiment of a motor-side mount.

FIG. 5 depicts side-, bottom-, and end-view representations of an embodiment of motor-side mount 150. Mount 150 may include openings 152. Openings 152 may be screw holes or other openings that allow attachment of a propulsion device (e.g., a motor) to mount 150. In certain embodiments, mount 150 includes raised edges 154 along a perimeter or outer edge of the mount on a bottom-side of the mount (e.g., the side of the mount that is coupled to the boat-side mount). Raised edges 154 may form and surround recess 156 on the bottom-side of mount 150. In certain embodiments, recess 156 is sized and shaped to sit over the boat-side mount when mount 150 is coupled to the boat-side mount (e.g., the recess allows mount 150 to sit over the boat-side mount and raised edges 154 conceal the boat-side mount under mount 150). Additionally, when mount 150 is coupled to the boat-side mount, raised edges 154 may prevent mount 150 from being moved or displaced during thrust motion caused by the propulsion device attached to mount 150.

In certain embodiments, mount 150 includes magnets 158. Magnets 158 may be a series of magnets in a line horizontally across mount 150. For example, magnets 158 may be a series of magnets aligned along a line (e.g., a centerline) of mount 150. Magnets 158 may be aligned along the centerline to match an alignment of magnets 104 in mount 100. In certain embodiments, magnets 158 includes four magnets in a line horizontally across mount 150 that are aligned to match a series of four magnets 104 in mount 100 (described above).

Figure 6:
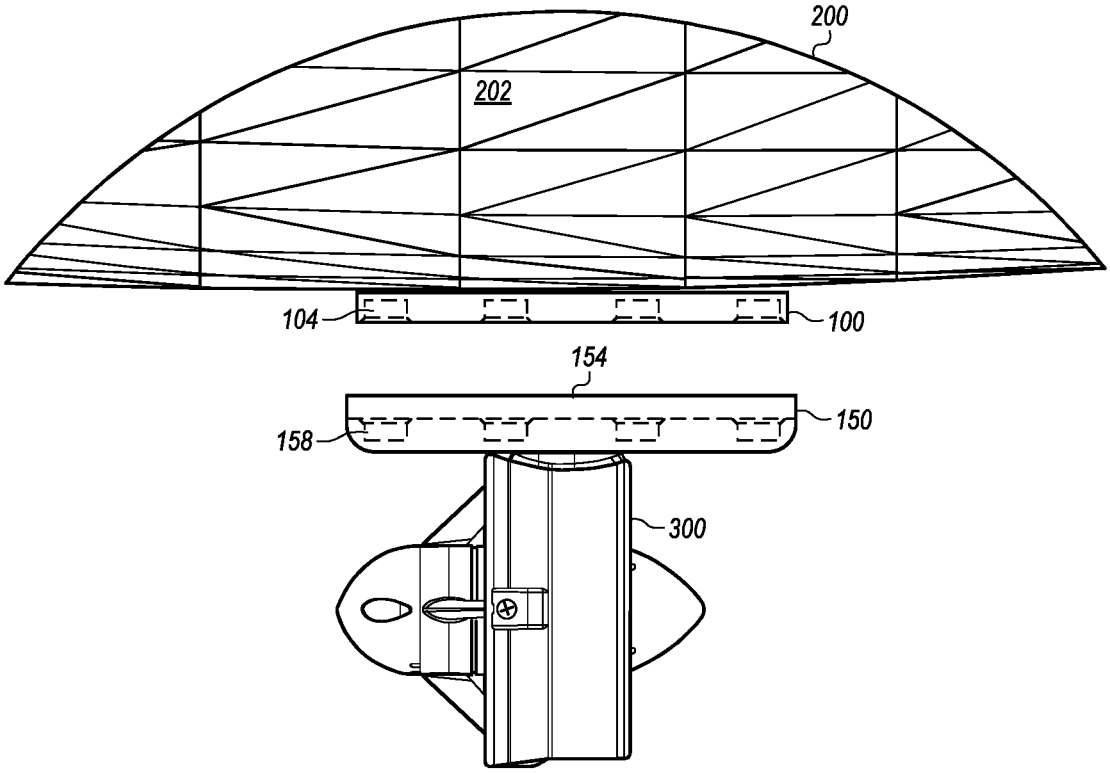
FIG. 6 depicts a side-view representation of a motor-side mount positioned in proximity to a boat-side mount.

FIG. 6 depicts a side-view representation of mount 150 positioned in proximity to mount 100. Mount 150 may be positioned in proximity to mount 100, for example, to couple mount 150 to mount 100. Mount 150 may be coupled to mount 100 to couple propulsion device 300 (e.g., the motor) to hull 202 of watercraft 200. As shown in FIG. 6, magnets 158 in mount 150 are aligned with magnets 104 in mount 100 as mount 150 is placed near (in proximity to) mount 100. The polarities in magnets 158 and magnets 104 may be predetermined and arranged such that when mount 150 is placed near mount 100, the magnets are attracted to each other. When magnets 158 are positioned close enough to magnets 104, the attraction between the magnets brings the magnets together and couples mount 150 to mount 100, thereby coupling propulsion device 300 to watercraft 200.

Figure 7:
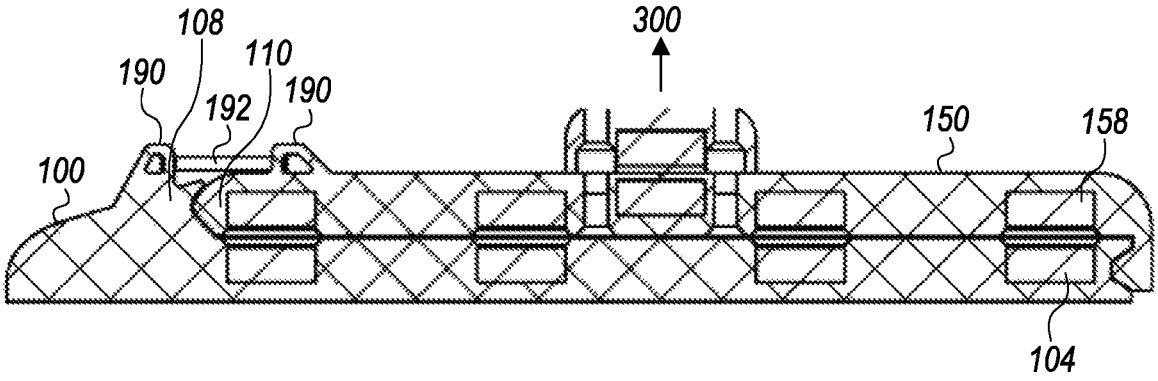
FIG. 7 depicts a cross-sectional side-view representation of a motor-side mount coupled to a boat-side mount using attraction between magnets.

FIG. 7 depicts a cross-sectional side-view representation of mount 150 coupled to mount 100 using attraction between magnets 158 and magnets 104. As shown in FIG. 7, magnets 158 are aligned with magnets 104 when mount 150 is coupled to mount 100. The attraction between magnets 158 and magnets 104 holds mount 150 to mount 100 until a sufficient force is provided to separate the magnets (e.g., overcome the attractive force between the magnets). Using the series of magnets on both mount 150 and mount 100 (e.g., series of four magnets on each mount) may provide a selected alignment between the mounts when the mounts are coupled. In certain embodiments, because of the alignment of magnets 158 in mount 150 and the alignment of magnets 104 in mount 100 along with the predetermined polarities of the magnets, mount 150 is coupled to mount 100 such that propulsion device is positioned in a correct orientation with respect to hull 202 of watercraft 200. For example, propulsion device 300 may be positioned, based on the alignment and polarities of magnets 104 and magnets 158, to provide forward propulsion of the watercraft when mount 150 is coupled to mount 100.

In some embodiments, propulsion device 300 is coupled to watercraft 200 such that the propulsion device is as close to hull 202 as possible (e.g., the propulsion device has a minimal clearance below the hull). Positioning propulsion device 300 with a minimal clearance below hull 202 may maximize the clearance between the propulsion device and the sea floor. Propulsion device 300 may also be of a minimum size needed to provide propulsion for watercraft 200 to further maximize the clearance between the propulsion device and the sea floor. In shallow waters, however, there may still be risk for damaging propulsion device through collision with either the sea floor or other foreign objects in the water. Thus, mount 100 and mount 150 may be designed to maximize clearance between propulsion device 300 and the sea floor.

In some embodiments, failsafe features may be added to mount 100 and/or mount 150 to prevent damage to propulsion device 300 and/or watercraft 200 if the propulsion device should contact a foreign object in the water. In some embodiments, as shown in FIG. 7, mount 150 may have been slid onto mount 100 from the rear (right side of FIG. 7). Mount 150 may be slid onto mount 100 using, for example, a keyed retention rail system.

Figure 8:
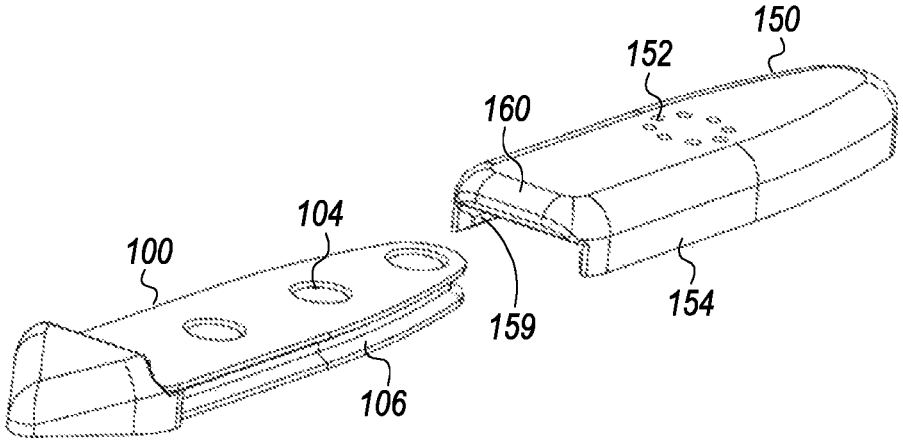
FIG. 8 depicts a perspective view representation of a motor-side mount being moved onto a boat-side mount with the mounts having an embodiment of a keyed retention rail system.

FIG. 8 depicts a perspective view representation of mount 150 being moved onto mount 100 with the mounts having an embodiment of a keyed retention rail system. In embodiments with the keyed retention rail system, mount 100 may include recessed channel 106 along a portion of the perimeter of the mount. Mount 150 may include a corresponding protrusion 159 along a portion of the perimeter of the mount 150 (e.g., on the inside of raised edges 154). Protrusion 159 and recessed channel 106 may be, for example, keyed retention rails that engage when mount 150 is moved onto mount 100. Protrusion 159 may engage recessed channel 106 as mount 150 is moved (slid) onto mount 100 and the engagement between the protrusion and the recessed channel may guide mount 150 onto mount 100 until magnets 158 are aligned with magnets 104 (as shown in FIG. 7).

In certain embodiments, when mount 150 is coupled to mount 100, portion 160 of mount 150 abuts portion 108 of mount 100. When propulsion device 300 is running and providing forward propulsion of watercraft 200, the propulsion pushes portion 160 of mount 150 against portion 108 of mount 100 (e.g., the propulsion is pushing the mounts together). In the event of a collision against propulsion device 300 (attached to mount 150), mount 150 may slide backwards, disengaging magnets 158 and magnets 104 (assuming the force overcomes the attractive force between the magnets) and sliding mount 150 off mount 100. This backwards sliding movement may inhibit or prevent damage to propulsion device 300 in the event of a collision.

Figure 9:
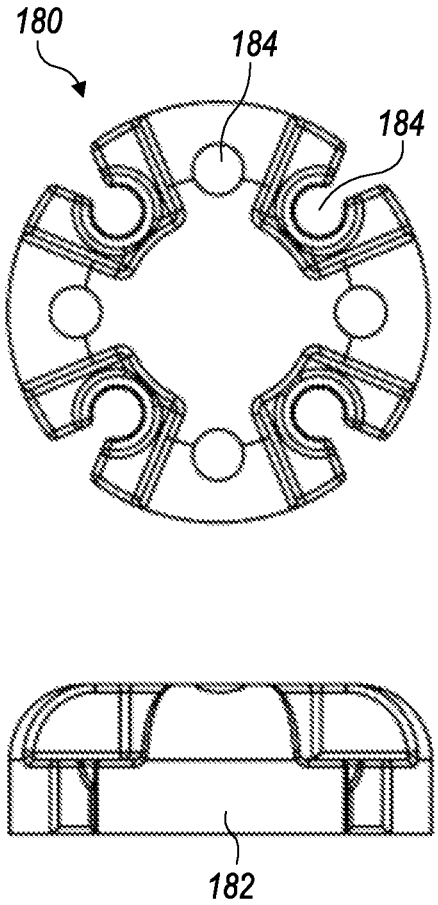
FIG. 9 depicts top- and side-view representations of an embodiment of a floating motor mount.

In certain embodiments, mount 150 is a stationary motor-side (propulsion-side) mount (e.g., mount 150 is intended to remain stationary on mount 100 except in the event of a collision with propulsion device 300 or removal of mount 150 from mount 100). In some embodiments, propulsion device 300 may be mounted (e.g., attached) to mount 150 using a floating motor mount. FIG. 9 depicts top- and side-view representations of an embodiment of floating motor mount 180. Mount 180 may include magnet 182 embedded in the mount. Mount 180 may include openings 184. Openings 184 may be screw holes or other openings that allow attachment of propulsion device 300 (e.g., a motor) to mount 180.

Figure 10:
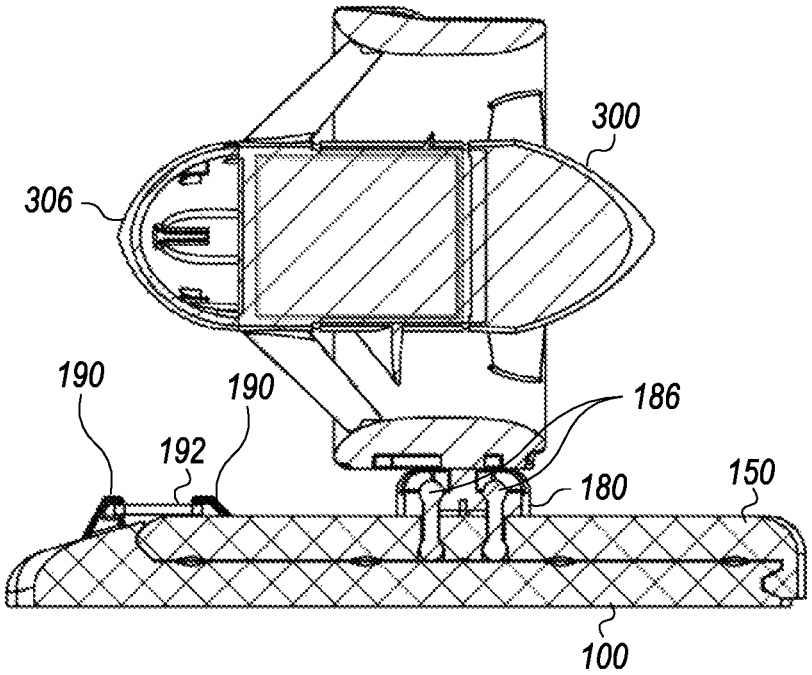
FIG. 10 depicts a cross-sectional side-view representation of an embodiment of a propulsion device coupled to a watercraft.

FIG. 10 depicts a cross-sectional side-view representation of an embodiment of propulsion device 300 coupled to a watercraft using mount 180, mount 150, and mount 100. After propulsion device 300 is attached to mount 180, mount 180 may be coupled mount 150. Mount 150 may include an additional magnet (not shown) that attracts magnet 182 in mount 180 (similar to the attraction between magnets 104 and magnets 158 described herein). The attraction between magnet 182 and the additional magnet in mount 150 may center propulsion device 300 on mount 150.

After mount 180 is magnetically mounted to mount 150, elastic studs 186 may be used to secure mount 180 to mount 150. In one embodiment, four elastic studs 186 are used to secure mount 180 to mount 150. Elastic studs 186 may guide propulsion device 300 such that the propulsion device is oriented straight with respect to watercraft 200. Additionally, elastic studs 186 may damped impacts on propulsion device 300 from the sea floor and/or foreign objects in the water. For example, if an object contacts propulsion device 300, magnet 182 may disengage with the magnet in mount 150 and elastic studs 186 will stretch, thereby allowing the propulsion device to flex out of the way of the object and then snap back into place guided by the elastic studs.

In some embodiments, mount 150 and mount 100 may include retention loops 190, as shown in FIGS. 7 and 10. Retention loops 190 may be used to provide more secure coupling between mount 150 and mount 100. For example, elastic band 192 may be used to couple retention loops 190 on mount 150 to retention loops 190 on mount 100. In some embodiments, other flexible or non-flexible (e.g., zip-tie) fasteners may be used to couple retention loops 190 together. Coupling retention loops 190 together with elastic band 192 may provide additional security in reducing or preventing damage of propulsion device 300 from contact by the sea floor or foreign objects. For example, in the event an object contacts propulsion device 300 and moves the propulsion device backwards, elastic band 192 may stretch before breaking, which may inhibit mount 150 from completely disengaging from mount 100. After the object is no longer contacting propulsion device 300, elastic band 192 may bring mount 150 back into full engagement with mount 100, thereby bringing the propulsion device back into position.

Figure 11:
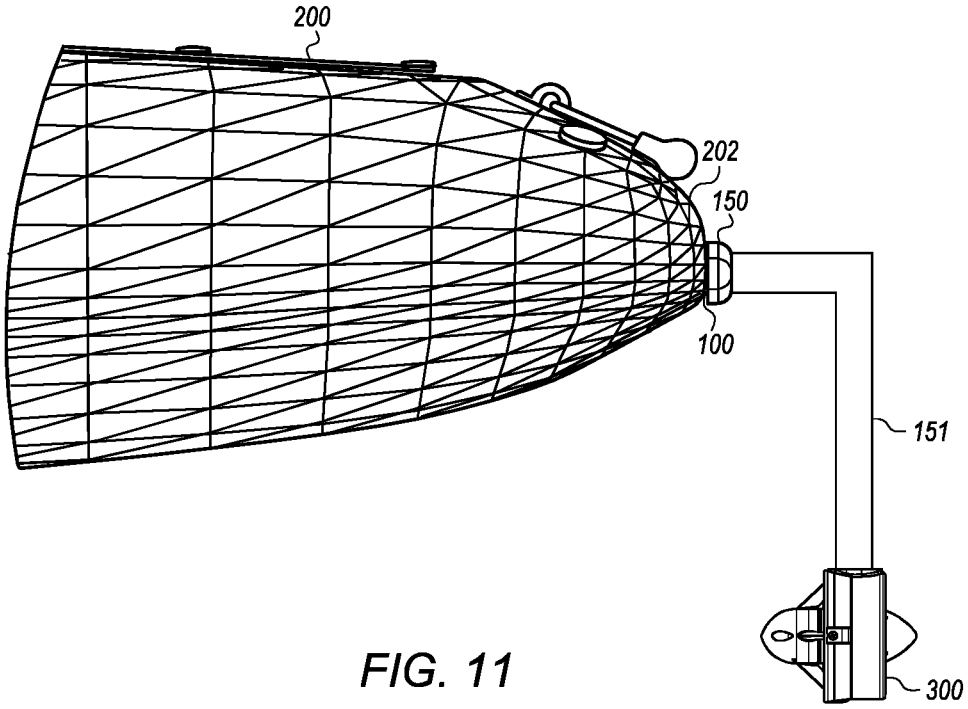
FIG. 11 depicts a side-view representation of an embodiment of a boat-side mount and a motor-side mount coupled to a back portion of a hull of a watercraft.

In some embodiments, a watercraft may lack a place to attach both the boat-side mount and the motor-side mount to the bottom of the hull of the watercraft. In such embodiments, a boat-side mount may be attached to a back of the hull. FIG. 11 depicts a side-view representation of an embodiment of boat-side mount 100 and motor-side mount 150 coupled to a back portion of hull 202 of watercraft 200. Mount 100 may be attached to hull 202 using techniques described herein. Mount 150 may be coupled to mount 100 using techniques described herein. Propulsion device 300 may be attached to mount 150 using shaft 151. Shaft 151 may allow propulsion device 300 to be lowered into the water at a 90° angle off the back of hull 202 so that the propulsion device is submerged into the water.

Figure 12:
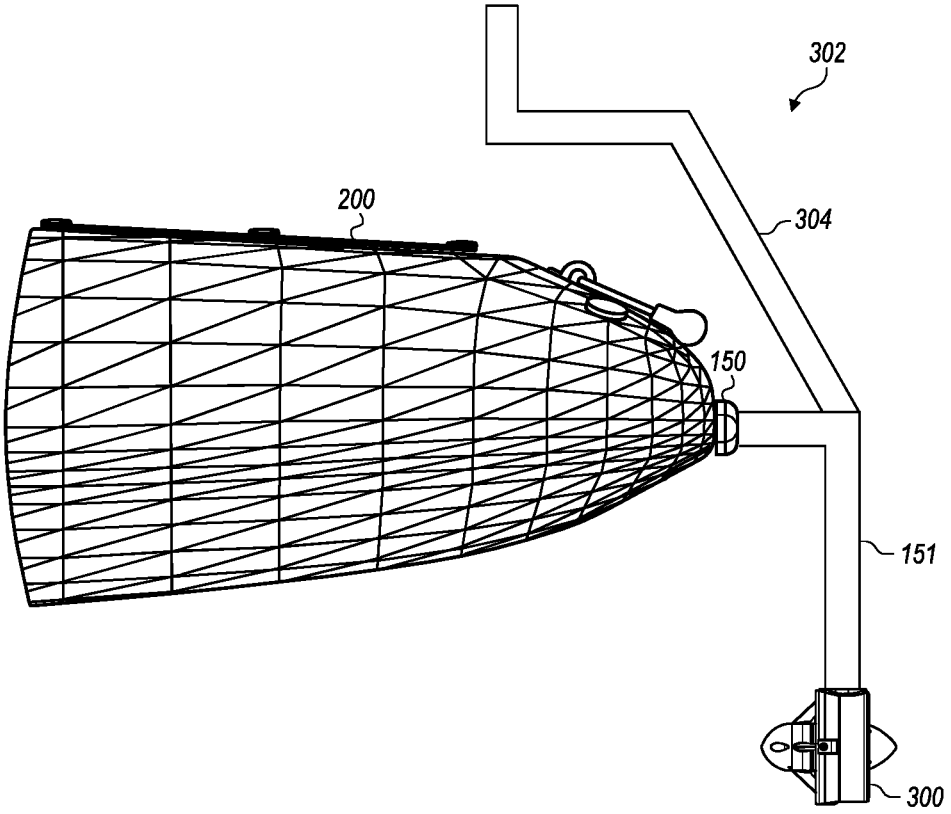
FIG. 12 depicts a side-view representation of an embodiment of a steering mechanism.

In some embodiments, a steering mechanism may be used with propulsion device 300 and any of the boat-side or motor-side mounts described herein. The steering mechanism may be used to provide an extra degree of control of the watercraft. In some embodiments, the steering mechanism includes a mechanism for steering the motor (e.g., controlling direction of propulsion using a rudder-type device). FIG. 12 depicts a side-view representation of an embodiment of steering mechanism 302. Steering mechanism 302 may include tiller 304 attached to shaft 151. In such an embodiment, shaft 151 may operate as a rudder for steering mechanism 302 by rotating at mount 150. Tiller 304 may be used to control a direction or steering angle of watercraft 200. Using steering mechanism 302 may allow a user to control steering of watercraft 200 without the use of a paddle. In some embodiments, a throttle stick (as described herein) may be attached to tiller 304 to allow the user to control speed at the tiller and while steering watercraft 200 (e.g., speed and direction may be controlled with one hand).

In some embodiments, steering of watercraft 200 may be provided by coupling two or more propulsion devices 300 to hull 202. With two propulsion devices 300 coupled to hull 202, variable (e.g., differential) control of the thrust provided by each propulsion device (as described herein) may be used to control the direction of travel of watercraft 200. For example, a user could select a select direction of travel on a handheld controller, which then controls thrust to the propulsion devices accordingly to provide the desired travel direction. In some embodiments, direction may be controlled using a GPS device or other navigational tool. For example, the user could set coordinates using a GPS device and the device could provide travel in an autopilot mode using the set coordinates. In such embodiments, the user may be on standby to override or correct the directional movement in the event of encountering another watercraft or a collision with a foreign object impedes the intended path.

Figure 13:
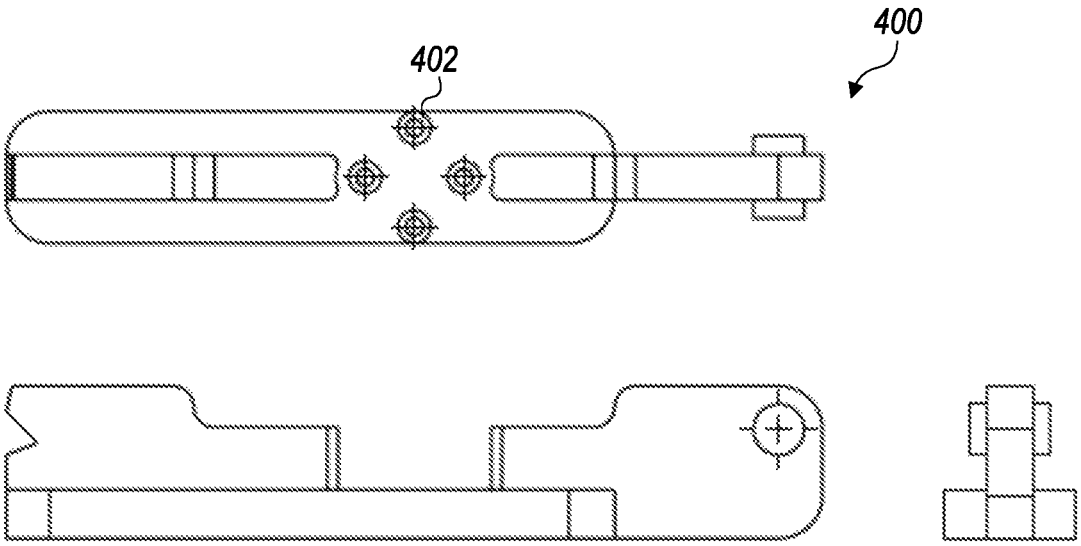
FIG. 13 depicts top-, side-, and end-view representations of an embodiment of a fin-replacement mount.
Figure 14:
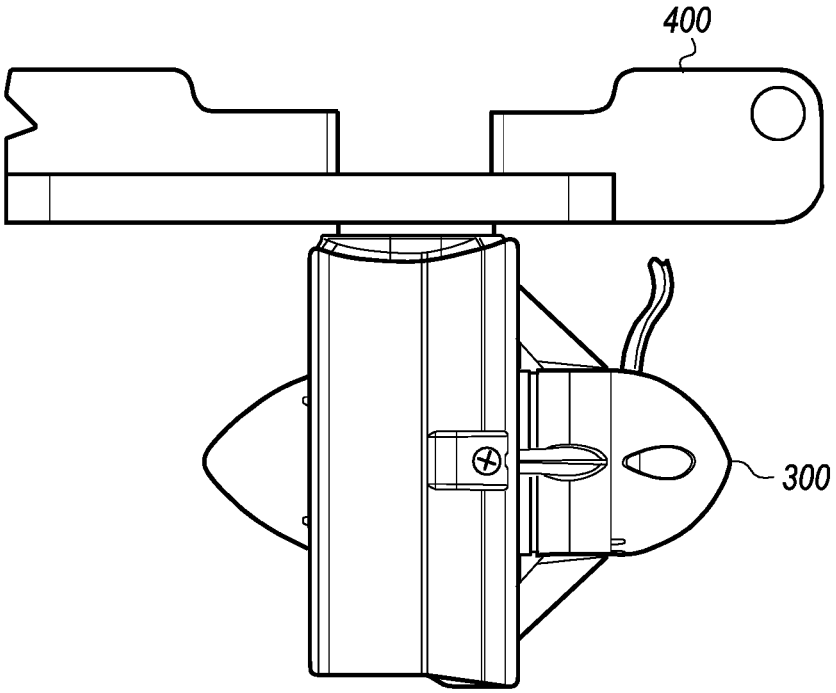
FIG. 14 depicts a representation of an embodiment of a propulsion device attached to a motor-side mount.

In some embodiments, a mount is designed for attachment to a hull having a fin or other removable attachment. For example, a SUP board or a surfboard may have a fin or other attachment that can be removed from the hull. In such embodiments, a single mount may be designed to replace the fin or other attachment and attach directly to the propulsion device. FIG. 13 depicts top-, side-, and end-view representations of an embodiment of fin-replacement mount 400. Mount 400 may include openings 402 for attaching a propulsion device to the mount. FIG. 14 depicts a representation of an embodiment of propulsion device 300 attached to mount 400. Mount 400 may be directly placed into a fin holder on the SUP board or surfboard (e.g., the watercraft). For example, the user may simply take out the existing fin and then place mount 400 in the fin holder before getting out on the water. In some embodiments, mount 400 slides into a mating piece on the SUP board or surfboard and a locking mechanism on the board keeps the mount in place. Mount 400 may be designed for any number of different type of SUP board or surfboard fin attachments (fin holders).

In some instances, a watercraft may include a cavity or recess in the hull. These cavities and recesses, for example, are commonly designed to house submersible sensors and transducers for fish finders such as the Hobie Guardian—Retractable Transducer Shield found on Hobie Cat Company kayaks. The cavity or recess in the hull may provide a place for retraction of a propulsion device to protect the propulsion device in the event of contact with a foreign object or when the propulsion device is not in use. In such embodiments, the motor-side mount (e.g., mount 150) may include a hinge or other mechanism that allows rotation of propulsion device. In these embodiments, the retractable transducer shield has been replaced with a retractable propulsion system, which may provide the user (e.g., kayaker) a seamless and integrated method to include secondary electronic propulsion in addition to the standard Hobie MirageDrive fin system.

Figure 15A:
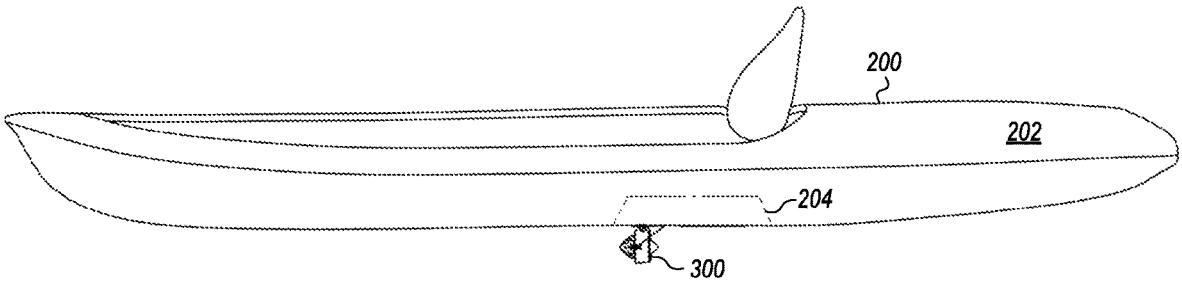
FIG. 15A depicts a side-view representation of an embodiment of a watercraft with a hull cavity in a hull and a propulsion device coupled to the hull.
Figure 15B:
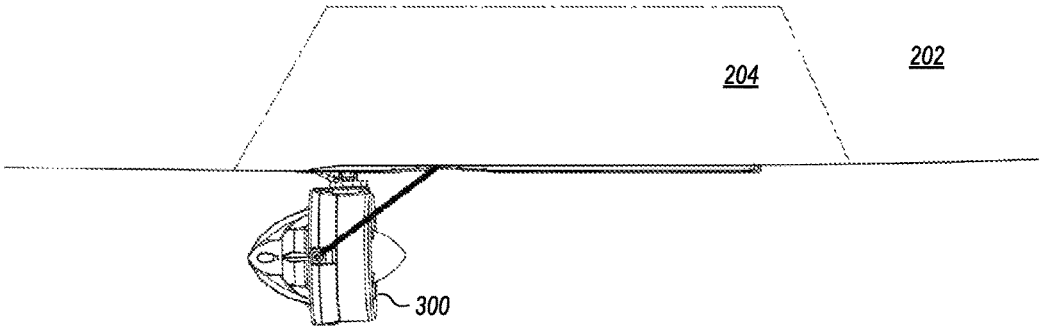
FIG. 15B depicts an exploded side-view representation of a propulsion device coupled to a hull at a hull cavity.

FIG. 15A depicts a side-view representation of an embodiment of watercraft 200 with hull cavity 204 in hull 202 and propulsion device 300 coupled to hull 202. FIG. 15B depicts an exploded side-view representation of propulsion device 300 coupled to hull 202 at hull cavity 204. Propulsion device 300 is shown in a deployed position in FIGS. 15A and 15B. The deployed position may be an operating position for propulsion device 300 (e.g., the position in which the propulsion device is used to provide propulsion for watercraft 200).

Figure 16:
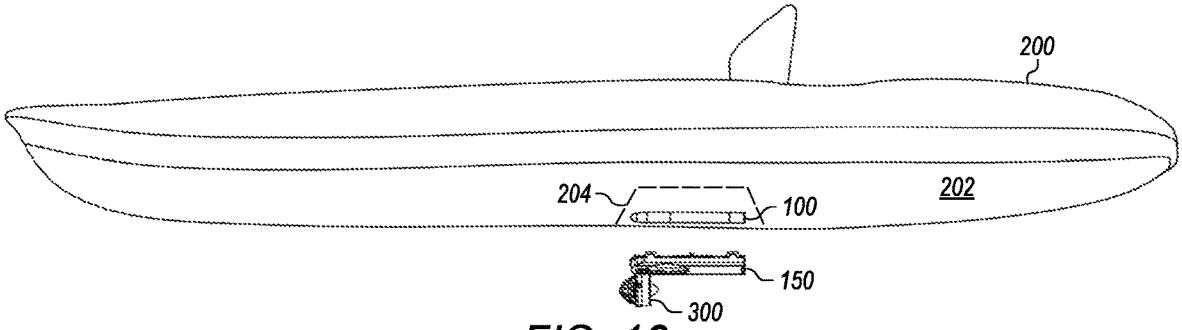
FIG. 16 depicts a side-view representation of an embodiment of a watercraft showing a boat-side mount on hull and a motor-side mount.
Figure 17:
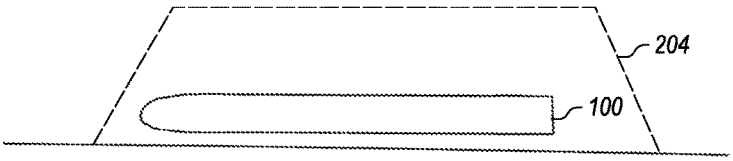
FIG. 17 depicts an exploded side-view representation of a boat-side mount on a hull and a motor-side mount before coupling of the mounts at a hull cavity.
Figure 17:
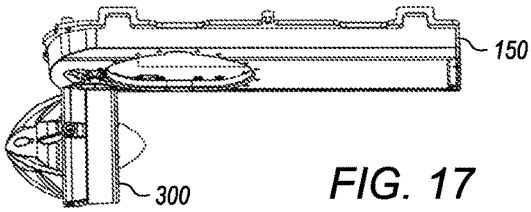

FIG. 16 depicts a side-view representation of an embodiment of watercraft 200 showing mount 100 on hull 202 and mount 150 before coupling of the mounts. FIG. 17 depicts an exploded side-view representation of mount 100 on hull 202 and mount 150 before coupling of the mounts at hull cavity 204. As described herein, mount 150 may be coupled to mount 100 to couple propulsion device 300 to hull 202 of watercraft 200.

Figure 18:
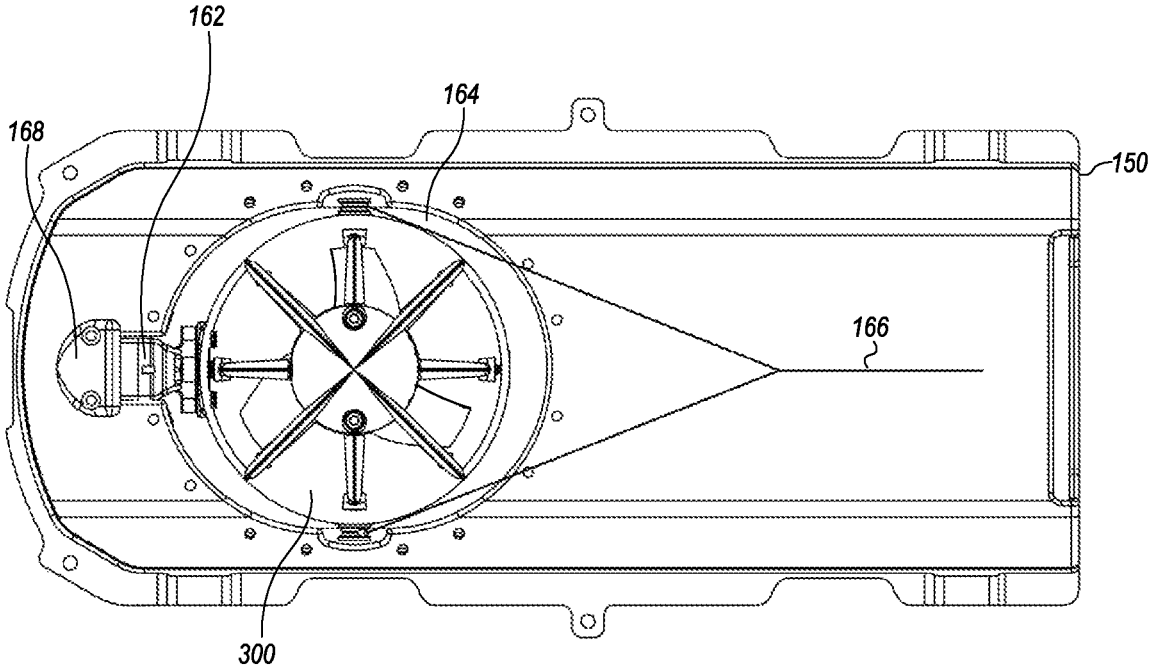
FIG. 18 depicts a bottom-view representation of an embodiment of a propulsion device partially retracted into a motor-side mount.

FIG. 18 depicts a bottom-view representation of an embodiment of propulsion device 300 partially retracted into mount 150. In certain embodiments, mount 150 includes hinge 162. Hinge 162 may be, for example, a spring-loaded hinge or include a spring. In certain embodiments, the spring provides force that automatically rotates propulsion device towards a retracted position (e.g., undeployed position) described below. In some embodiments, hinge 162 includes an angle position sensor that detects an angle of the hinge and/or a position state of the hinge (e.g., the hinge mechanism). For example, the angle position sensor may be an axial rotation sensor located at or near a centerline of hinge 162. The axial rotation sensor may assess rotational motion and position of hinge 162 (e.g., the hinge mechanism).

As shown in FIG. 18, propulsion device 300 is partially retracted into opening 164 in mount 150. Opening 164 may allow propulsion device 300 to move, while rotating on hinge 162, through the body of mount 150 as described further below. In certain embodiments, tether 166 is coupled to propulsion device 300. Tether 166 may be attached at its other end to watercraft 200. Tether 166 may be used to provide force to retract propulsion device 300 into the hull cavity.

In some embodiments, mount 150 includes sensor 168. Sensor 168 may be used to detect forward movement of watercraft 200. Sensor 168 may include an adjustable motor stop. Hinge 162 and/or a portion of propulsion device 300 may abut the adjustable motor stop. Sensor 168 may also include a force transducer. When watercraft 200 is moved forward by a sudden force change (e.g., by either a paddle stroke or a pedal stroke (if equipped)), the pressure of hinge 162 and/or the portion of propulsion device 300 against the adjustable motor stop may change. The force transducer may detect the change in pressure, which is indicative of the forward motion event caused by the paddle stroke or pedal stroke (e.g., a manual propulsion event). Measurements of the forward motion events by sensor 168 may be used to determine paddle assistance provided by propulsion device 300, as described herein.

In some embodiments, the angle position sensor and/or position state in hinge 162 may be used to detect a forward motion event. For example, changes in the angle or position state of hinge 162, as detected by the angle position sensor, may be used to determine if a forward motion event has occurred. In some embodiments, the angle and/or position state of hinge 162 may be used in combination with measurement by sensor 168 to determine a forward motion event.

Figure 19:
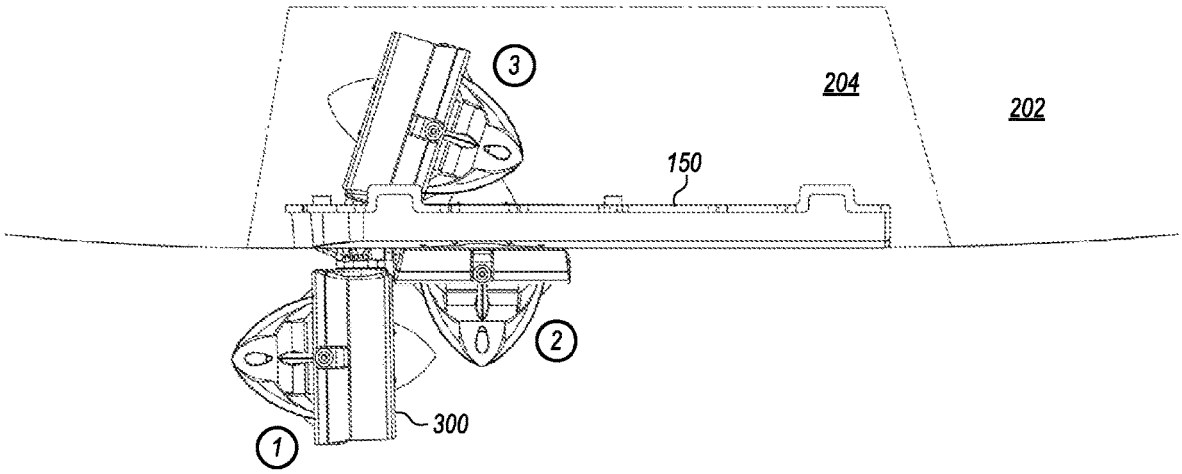
FIG. 19 depicts an enlarged side-view representation of an embodiment of a propulsion device in three different positions on a motor-side mount.

FIG. 19 depicts an enlarged side-view representation of an embodiment of propulsion device 300 in three different positions on mount 150 coupled at hull cavity 204. In position 1, propulsion device 300 is in the deployed position (e.g., the operating position). In position 2, propulsion device 300 is in the partially retracted (e.g., cleaning position described below). In position 3, propulsion device 300 is in the retracted (e.g., fully retracted) or undeployed position. As described above, propulsion device 300 may rotate on hinge 162 and move through opening 164 to move between the three positions on mount 150.

Figure 20:
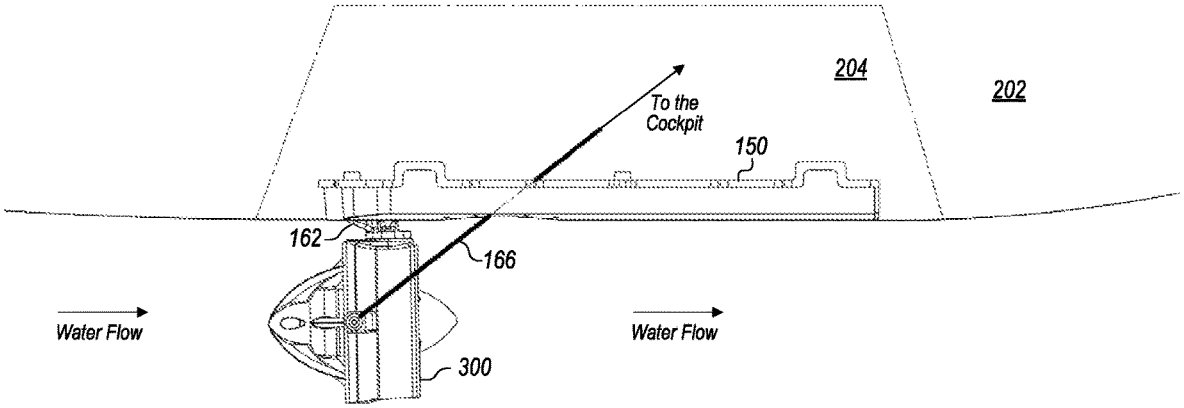
FIG. 20 depicts an enlarged side-view representation of an embodiment of a propulsion device in the deployed position on a motor-side mount coupled at a hull cavity.
Figure 21:
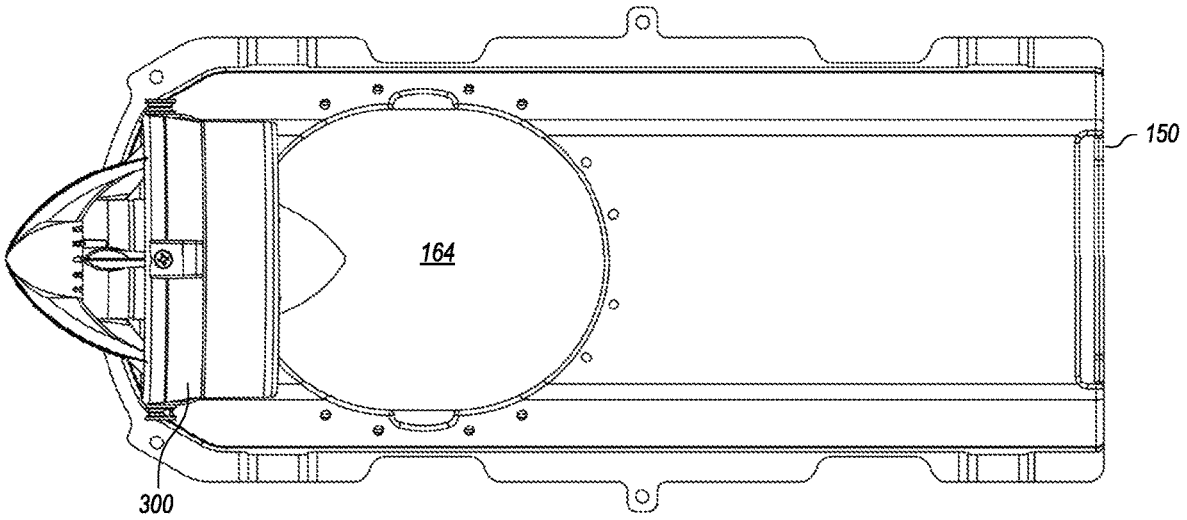
FIG. 21 depicts an enlarged bottom-view representation of an embodiment of a propulsion device in the deployed position on a motor-side mount.

FIG. 20 depicts an enlarged side-view representation of an embodiment of propulsion device 300 in the deployed position on mount 150 coupled at hull cavity 204. FIG. 21 depicts an enlarged bottom-view representation of an embodiment of propulsion device 300 in the deployed position on mount 150. The arrows in FIG. 20 show the direction of water flow when propulsion device 300 is under normal (forward propulsion) operation. In some embodiments, hinge 162 allows propulsion device 300 to rotate to the deployed position when the propulsion device is turned on (e.g., when thrust from the propulsion device is activated). For example, the thrust force provided by propulsion device 300 may overcome any counteracting force provided by hinge 162 (e.g., the spring in the hinge) that attempts to rotate the propulsion device towards the retracted (undeployed position) (e.g., the propulsion device automatically rotates to the deployed position when the propulsion device is turned on).

Figure 22:
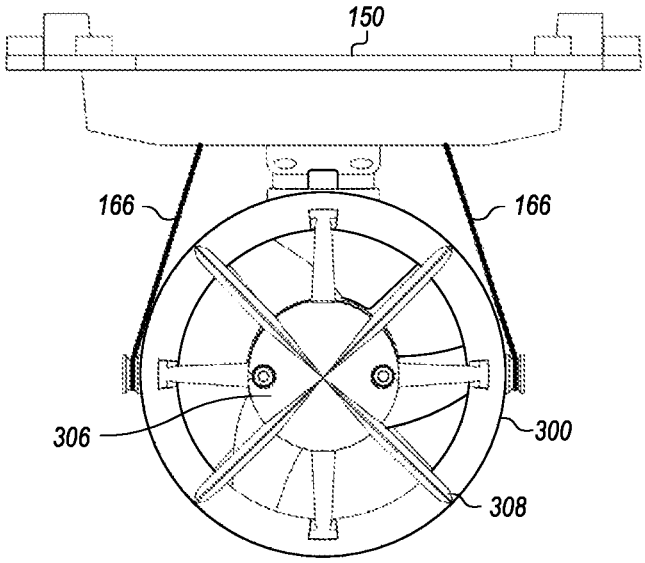
FIG. 22 depicts an enlarged front-view representation of an embodiment of a propulsion device in the deployed position on a motor-side mount.

FIG. 22 depicts an enlarged front-view representation of an embodiment of propulsion device 300 in the deployed position on mount 150. In certain embodiments, propulsion device 300 includes sensor unit 306 in a nose portion of the propulsion device. In some embodiments, propulsion device 300 includes debris/seaweed cutter 308 in front of the blades of the propulsion device.

Figure 23:
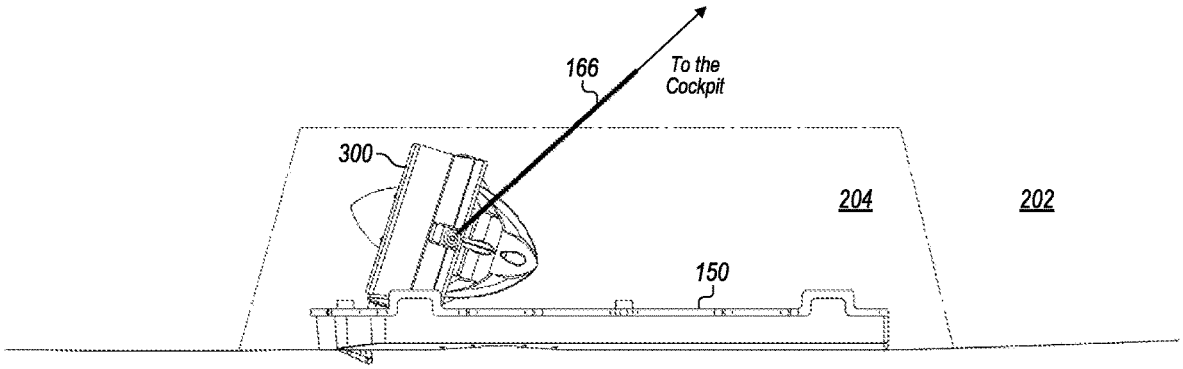
FIG. 23 depicts an enlarged side-view representation of an embodiment of a propulsion device in the retracted (undeployed) position on a motor-side mount coupled at a hull cavity.
Figure 24:
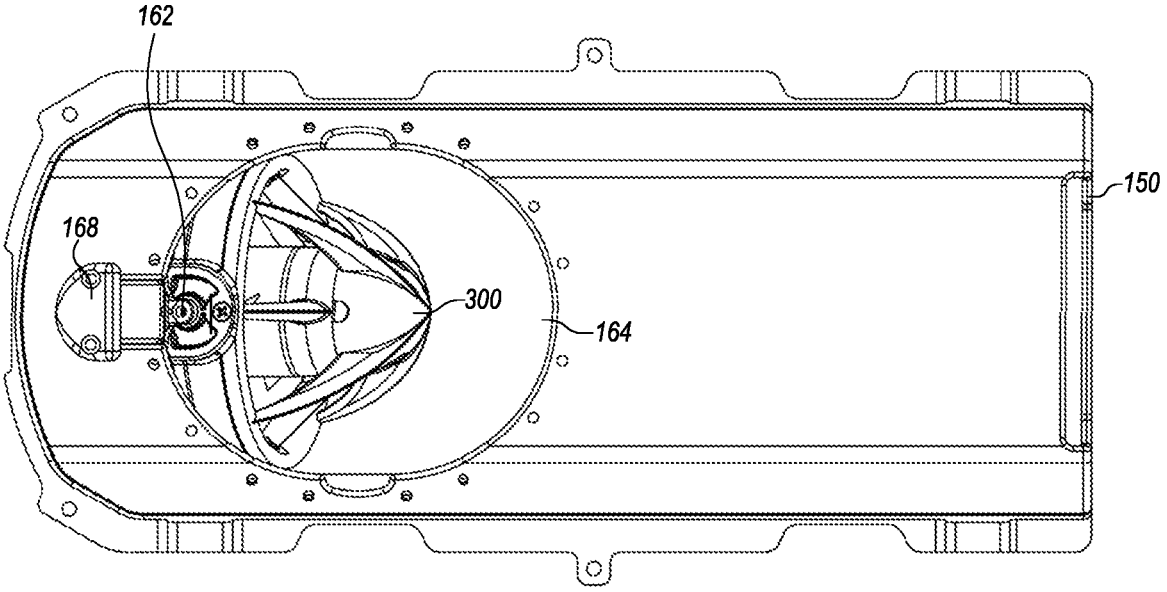
FIG. 24 depicts an enlarged bottom-view representation of an embodiment of a propulsion device in the undeployed position on a motor-side mount.

FIG. 23 depicts an enlarged side-view representation of an embodiment of propulsion device 300 in the retracted (undeployed) position on mount 150 coupled at hull cavity 204. FIG. 24 depicts an enlarged bottom-view representation of an embodiment of propulsion device 300 in the undeployed position on mount 150. In the undeployed position, propulsion device 300 may be rotated into hull cavity 204 (e.g., above a bottom of hull 202). In some embodiments, propulsion device 300 is rotated into the undeployed position automatically when the propulsion device is turned off (e.g., when the propulsion device is not actively producing thrust). For example, propulsion device 300 may be rotated into the undeployed position by hinge 162 and/or tether 166. In some instances, automatic rotation of propulsion device 300 includes passive rotation of the propulsion device into the undeployed position (e.g., the propulsion device begins to rotate when thrust is turned off due to forces from the flow of water against the propulsion device). In some embodiments, tether 166 may be coupled to the cockpit (e.g., user area) of watercraft 200. In such embodiments, the user may pull tether 166 to retract propulsion device 300 when needed (e.g., when an obstruction or shallow area is encountered).

Retracting propulsion device 300 inside hull cavity 204 into the undeployed position provides a safe and secure position for the propulsion device when the propulsion device is not in use and/or when the propulsion device encounters a foreign object in the water. Retraction of propulsion device 300 inside hull cavity 204 may additionally reduce drag when the watercraft is in motion (e.g., during additional paddle strokes or while the watercraft cruises without propulsion assistance). Retraction (or partial retraction) of propulsion device 300 may also allow watercraft 200 to be operated in very shallow water as the propulsion device can be retracted as needed depending on the depth of the water. In some instances, in the event that propulsion device 300 contacts a foreign object in the water while in the deployed position (shown in FIGS. 20-22), the propulsion device may be rotated towards the retracted (undeployed position) by the force of the contact. Such rotation may reduce the likelihood or prevent damage to propulsion device 300.

Figure 25:
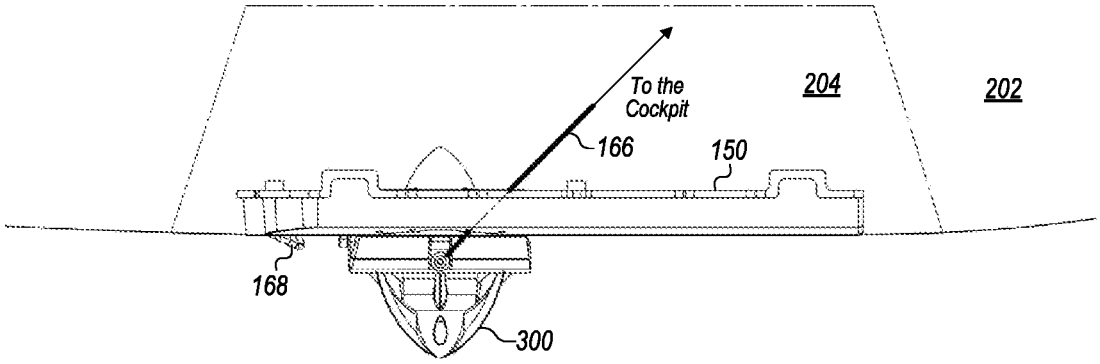
FIG. 25 depicts an enlarged side-view representation of an embodiment of a propulsion device in the partially retracted (e.g., cleaning) position on a motor-side mount coupled at a hull cavity.

FIG. 25 depicts an enlarged side-view representation of an embodiment of propulsion device 300 in the partially retracted (e.g., cleaning) position on mount 150 coupled at hull cavity 204. In the cleaning position, propulsion device 300 is rotated perpendicular to forward motion of watercraft 200. In some embodiments, in the cleaning position, propulsion device 300 may be operated in a reverse mode to clean debris from the propulsion device. Operation of propulsion device 300 in the cleaning position may be automatically controlled or manually controlled (e.g., using central control unit 502 described herein).

For a user to utilize a propulsion device coupled to a watercraft as described herein, a user may transport the watercraft and the propulsion device attached to the motor-side mount (e.g., mount 150) to the desired location (e.g., the body of water for intended use). At the desired location, the user may couple the motor-side mount to the boat-side mount. In certain embodiments, the propulsion device is controlled using a central control unit that can be positioned on or in the watercraft. The central control unit may be provided, along with the boat-side and motor-side mounts, as part of a paddle assistance and propulsion system.

Figure 26:
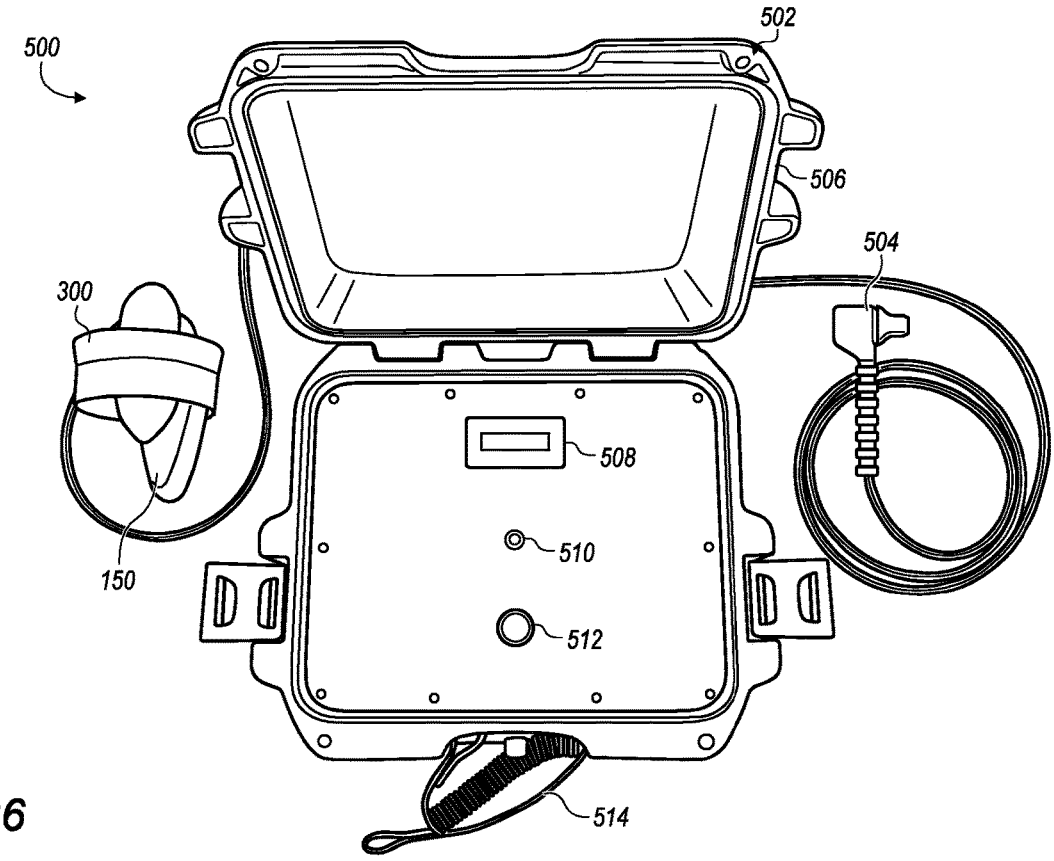
FIG. 26 depicts a representation of an embodiment of a paddle assistance and propulsion system.

FIG. 26 depicts a representation of an embodiment of paddle assistance and propulsion system 500. System 500 may include propulsion device 300 and mount 150 (with the propulsion device attached to the mount) along with central control unit 502 and throttle control unit 504. In certain embodiments, central control unit 502 includes waterproof case 506. Case 506 may enclose electronic components or other water-sensitive components and prevent water intrusion when central control unit 502 is used on watercraft 200.

In certain embodiments, throttle control unit 504 and propulsion device 300 are connected to central control unit 502 using wires. In some embodiments, throttle control unit 504 and propulsion device 300 are permanently connected to case 506 using waterproof cabling. In such embodiments, case 506 may include mounts for attaching throttle control unit 504 and propulsion device 300 while transporting system 500. In some embodiments, throttle control unit 504 and propulsion device 300 are coupled to case 506 using detachable wiring to allow separation of the components for transport. In some embodiments, throttle control unit 504 and/or propulsion device 300 may be connected to central control unit 502 using wireless technology. Propulsion device 300 may have its own power source in wireless technology embodiments.

Central control unit 502 may include a rechargeable battery to provide power to the central control unit and, in some embodiments, when coupled using wires, propulsion device 300. Central control unit 502 may include a programmable electronics board that distributes power, controls modes and functions (e.g., paddle assistance modes described herein). In some embodiments, central control unit 502 includes additional sensor and/or integrated circuits that provide additional capabilities for system 500. For example, central control unit 502 may include GPS, magnetometer/digital compass, accelerometer, and/or gyroscope capabilities. Central control unit 502 may also include attachment points to power additional accessories such as, but not limited to, navigation lights, speakers, phone charging, and power sources for other watercraft accessories.

In certain embodiments, central control unit 502 includes indicator 508. Indicator 508 may be a voltmeter or other indicator inside central control unit 502 that provides status of the battery (e.g., battery capacity). Charging plug 510 may also be located inside central control unit 502 and used for recharging the battery. In some embodiments, on/off switch 512 is located inside central control unit 502.

Emergency cutoff switch 514 may be coupled to the outside of case 506. Switch 514 may be a lanyard or other device worn by the user that is attached to case 506. In certain embodiments, switch 514 must be attached to a home region on case 506 in order for power to be provided to propulsion device 300. Switch 514 may be attached to the user or operator (e.g., on the wrist or ankle of the user). If the watercraft flips or the user is separated from the watercraft, switch 514 will be disengaged from case 506 and power to propulsion device 300 is turned off.

Figure 27:
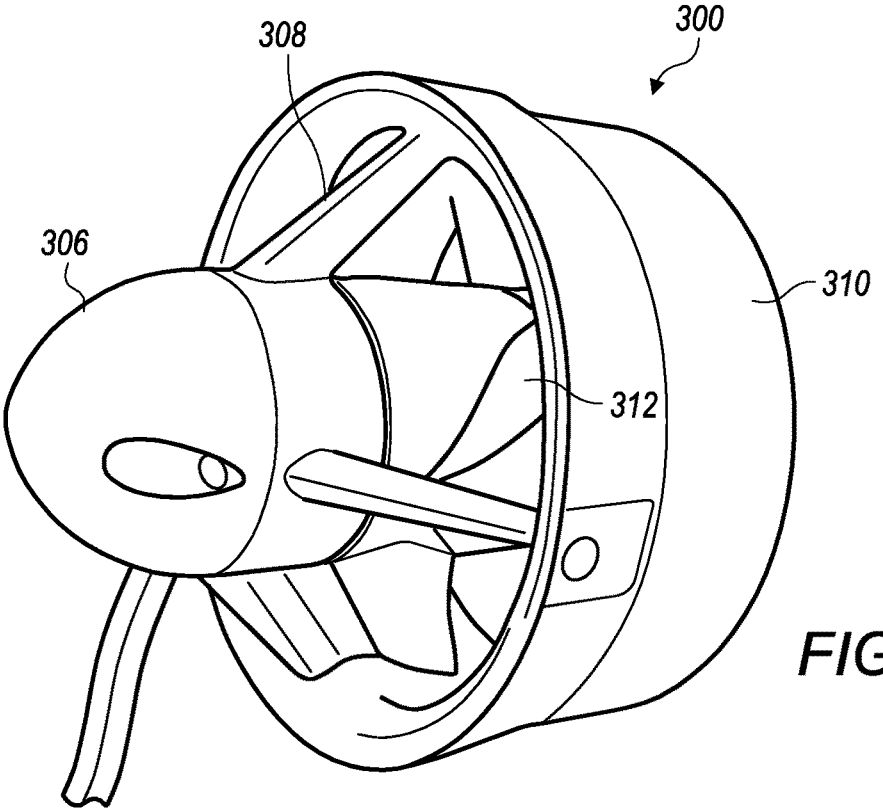
FIG. 27 depicts a representation of an embodiment of a propulsion device.

FIG. 27 depicts a representation of an embodiment of propulsion device 300. As described above, propulsion device 300 may be coupled to case 506 via waterproof cabling or via wireless communication (with the propulsion device including its own power source). Propulsion device 300 may be a commercially available motor suitable for underwater use. For example, propulsion device 300 may include a brushless waterproof motor coupled to impellers 312 inside housing 310. In certain embodiments, propulsion device 300 includes sensor unit 306 in the nose cone portion of the propulsion device. Sensor unit 306 may include a suite of sensors to provide a variety of measurements associated with propulsion device 300. In certain embodiments, sensor unit 306 includes thrust output and water speed sensors. In other embodiments, sensor unit 306 may include, for example, GPS, magnetometer/digital compass, accelerometer, and/or gyroscope capable sensors. These sensors may be used in combination or in place of similar sensors on central control unit 502 (described above). In yet other embodiments, sensor unit 306 may include additional sensors such as, but not limited to, sensors for water flow, temperature, optical clarity, depth, and fish finding transducers.

As described above, in some embodiments, multiple propulsion devices 300 (e.g., two propulsion devices) may be coupled to the watercraft to provide integrated steering of the watercraft based on controlling thrust differential between the propulsion devices. Integrated steering functions with propulsion devices 300 may be provided in combination with directional sensing capabilities (provided by, for example, an onboard GPS unit and/or digital compass sensor) to set a course line for the watercraft using GPS coordinates and/or magnetic heading. Using the integrated steering in combination with the directional control may allow system 500 to maintain the watercraft on a directional track using differential thrust to automatically compensate for drift or changes (e.g., adverse yaw or heading deviations) caused by water current and/or winds (e.g., system 500 provides autopilot control of direction of the watercraft). The integrated steering provided by differential thrust between multiple propulsion devices may provide steering/directional control without the need for a moving motor mount. Such integrated steering may be more robust and less likely to have mechanical failure. Control of the integrated steering, either using autopilot or manual control, may be operated using throttle control unit 504, as described below.

Figure 28:
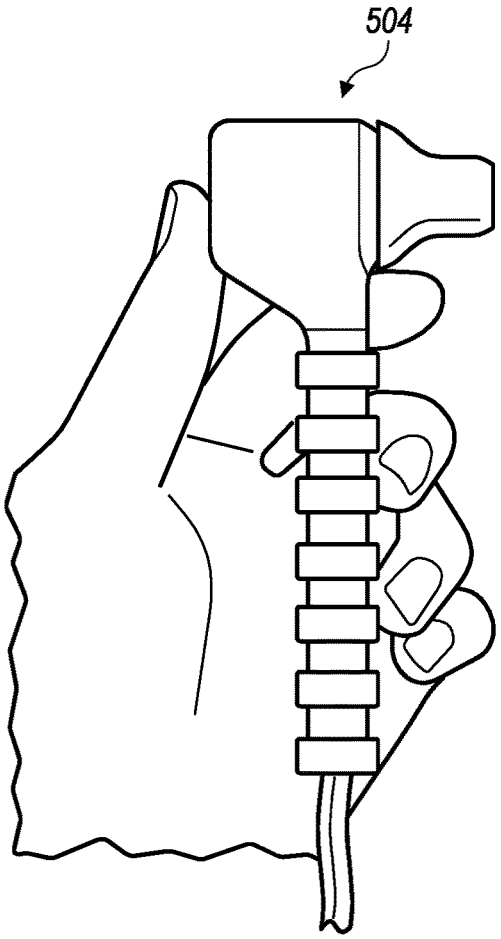
FIG. 28 depicts a representation of an embodiment of a throttle control unit.

FIG. 28 depicts a representation of an embodiment of throttle control unit 504. Unit 504 may include components to turn system 500 on/off, adjust the mode of system 500 (e.g., the paddling assistance mode as described herein), speed, power, and/or steering settings. In some embodiments, unit 504 provides visual feedback to the user. For example, unit 504 may include LEDs and/or graphical displays for visual feedback as well as components for auditory feedback (e.g., a waterproof speaker).

In certain embodiments, unit 504 is used to control speed provided by propulsion device 300 while the user operates the watercraft. As described above, unit 504 may be coupled to case 506 via waterproof cabling or via wireless communication. Unit 504 may be waterproof and be ergonomically designed to provide a comfortable form factor for the user. Unit 504 may contain a sealed potentiometer coupled to a rotatable knob. The user may variably adjust the speed of the watercraft by rotating the knob counterclockwise or clockwise as needed. The potentiometer may allow the user to variable adjust the speed in both forward and reverse directions. In a mid-range, the potentiometer may place propulsion device 300 in a standby mode.

In certain embodiments, rotating the potentiometer counter clockwise accelerates the watercraft forward while rotating the potentiometer clockwise accelerates the watercraft in reverse. In some embodiments, unit 504 and propulsion device 300 are designed to provide suitable speeds for safe operation of the watercraft. For example, at full throttle on unit 504, propulsion device may propel the watercraft to travel at speeds up to about 5 miles per hour at optimal conditions (e.g., little to no wind or current). The flexibility provided by variable speed control using unit 504 may allow the user to maneuver out of tight areas. In embodiments with multiple propulsion devices coupled to the watercraft, unit 504 may include an additional knob to control or set the direction of the watercraft in addition to the speed control knob.

In some embodiments, unit 504 includes additional components to provide additional features. For example, unit 504 may include additional features such as, but not limited to, a remote kill switch, a button indicator, speed display, and direction of travel. Additional information may be provided (e.g., communicated) to unit 504 from central control unit 502.

In certain embodiments, unit 504 is used to control one more paddle assistance modes (described herein). For example, unit 504 may be used to set a desired cruising speed. In such a case, the user may set the desired cruising speed without need for additional interaction with unit 504. The user may steer the watercraft using a paddle or other device while central control unit 502 controls the speed set using unit 504. In some embodiments, central control unit 502 may utilize data input from sensors (e.g., sensor unit 306) and provide automatic control of the pacing and power of the thrust provided from propulsion device(s) 300, depending on the paddle assistance mode selected, to match the user's stroke and propel the watercraft as desired. Such control may allow the user to have a great degree of flexibility and use system 500 in different modes for varying situations. For example, depending on the desired level of activity, the user may easily switch between more leisurely modes with high paddle-assistance to those with less paddle-assistance for more vigorous exercise modes.

A variety of paddle assistance modes may be provided by system 500. One embodiment of a paddle assistance mode may include providing propulsion assistance to achieve and maintain a set watercraft speed rate (e.g., "a speed rate assist mode"). In such an embodiment, the user may select a desired speed rate (e.g., using unit 504). Propulsion assistance may then be provided by system 500 when the speed rate drops below the desired speed rate. This paddle assistance mode may utilize speed input data from either an integrated GPS sensor or a direct water speed measurement from a water speed sensor attached to propulsion device 300 or mount 150. Central control unit 502 may utilize the speed input data to provide propulsion assistance accordingly. In this embodiment, the user may paddle as desired and when fatigued or slowing down, system 500 may provide assistance to maintain the watercraft's speed.

Figure 29:
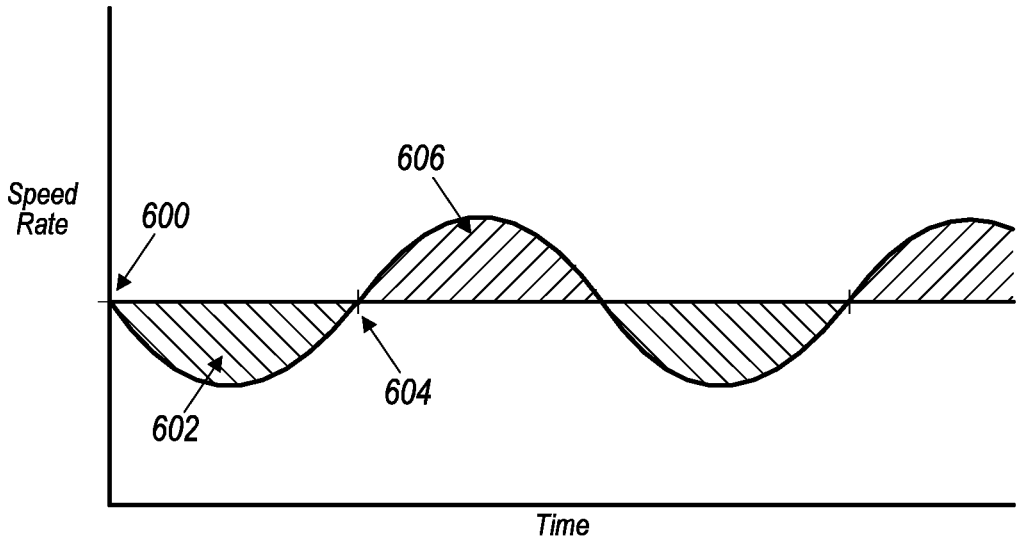
FIG. 29 depicts a plot of speed rate versus time for an embodiment of the speed rate assist mode.

FIG. 29 depicts a plot of speed rate versus time for an embodiment of the speed rate assist mode described above. Set point 600 may the set point for the desired speed rate. Region 602 may be an active assist mode region where the speed rate drops below the desired speed rate and system 500 provides propulsion assistance to the watercraft using propulsion device 300. At 604, the user may provide a paddle stroke, which increases the speed rate into region 606. Region 606 may be a no assist region where no propulsion is provided by system 500. This process may continue as needed during the operation of the watercraft.

Another embodiment of a paddle assistance mode may include providing paddle assistance after a paddling stroke has been made (e.g., a "paddle detection assist mode"). In such an embodiment, a user actively participates in paddling (or pedaling, if equipped) of the watercraft and system 500 provides a speed boost using electronic control of propulsion device 300. In certain embodiments, force detection from one or more sensors coupled to propulsion device 300 and/or mount 150 are used to determine a paddle stroke event. For example, sensor 168, described above, may be used to detect changes in force on the sensor that are indicative of a forward motion event (e.g., a pedal stroke event).

Figure 30:
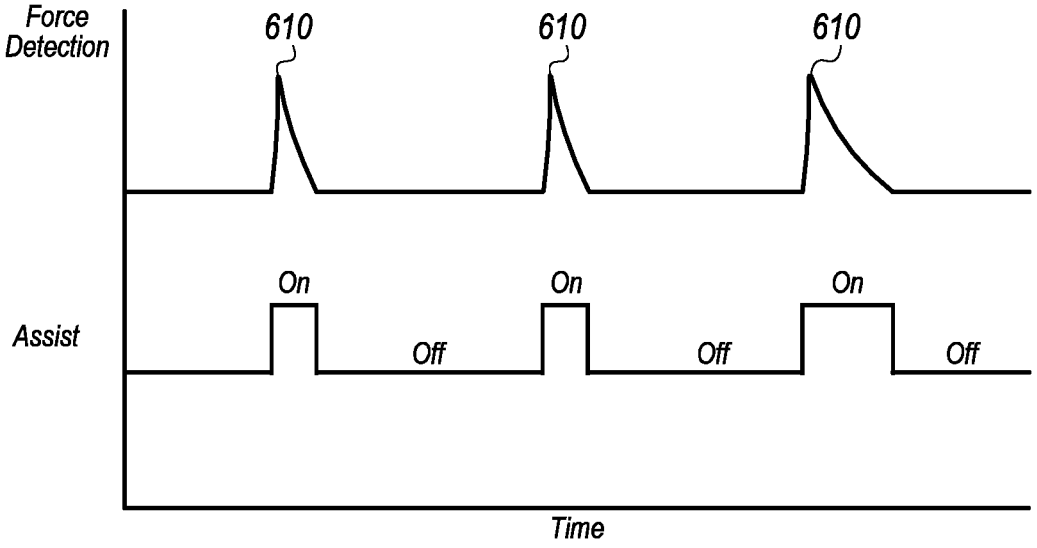
FIG. 30 depicts a plot of force detection and assist on/off versus time for an embodiment of the paddle detection assist mode.

FIG. 30 depicts a plot of force detection and assist on/off versus time for an embodiment of the paddle detection assist mode. Sensor 168 may be used to detect force that is assessed by central control unit 502 to determine when propulsion assistance is to be provided by system 500. As shown in FIG. 30, the detected force increases sharply and trails off at forward motion events 610. System 500 may provide propulsion assistance (assist "on") during these forward motion events and then no assistance (assist "off") after the forward motion event ends. In some embodiments, the amount of propulsion assistance may be varied. For example, the amount of propulsion assistance may be varied based on the amount of force detected by sensor 168 (e.g., a maximum force detected by the sensor).

In some embodiments, forward motion events may be detected using other sensors coupled to propulsion device 300 (e.g., sensors in sensor unit 306) and/or central control unit 502. For example, data from an accelerometer may be used to detect forward G-forces over a set threshold that indicate a forward motion event. In some embodiments, data from a water speed sensor may be used to determine a forward motion event. In some embodiments, data from a gyroscope sensor attached to a user's paddle may be used to determine a forward motion event (e.g., a set combination of x-, y-, and z-axis motions may be predetermined and loaded into central control unit 502 to represent a paddle stroke).

In some embodiments, a watercraft may include pedals coupled to and designed to move fins, flippers, a paddle wheel or propellers on the bottom of the hull. The user may operate the pedals to provide forward (or reverse) motion of the watercraft. In such embodiments, the forward motion event or "paddle stroke" may be a manual propulsion event provided by the pedals on the watercraft and not necessarily a paddle. A force sensor may be attached to the pedals (or paddles) and used to detect a forward motion event (e.g., a manual propulsion event caused by operation of the pedals).

In the embodiment of the paddle detection assist mode, the response of propulsion device 300 may be customized based on the user's unique paddle stroke and speed to provide varying degrees of assistance and a predictive power pulse. Providing the varying degrees of assistance and the predictive power pulse may produce smooth motion of the watercraft. In some embodiments, additional settings may be programmed into system 500 to add propulsion assistance during the paddle stroke and for a set time afterwards. For example, propulsion assistance may be provided during the paddle stroke plus 3, 4, or 5seconds of additional time after the paddle stroke is completed.

Yet another embodiment of a paddle assistance mode may include providing a pacing mechanism for paddle assistance (e.g., a "paddle training mode"). In such an embodiment, a user may set a desired pace for the user's paddle stroke. At each pacing interval, system 500 may determine if a paddle stroke has occurred (e.g., a forward motion event as described above). If the paddle stroke has not occurred, system 500 may provide propulsion assistance during that pacing interval. If the paddle stroke does occur, however, system 500 does not provide any propulsion assistance during that pacing interval. In some embodiments, a pacing cue may be provided by system 500. The pacing cue may be, for example, a visual or auditory alert to the user to begin a paddle stroke.

Figure 31:
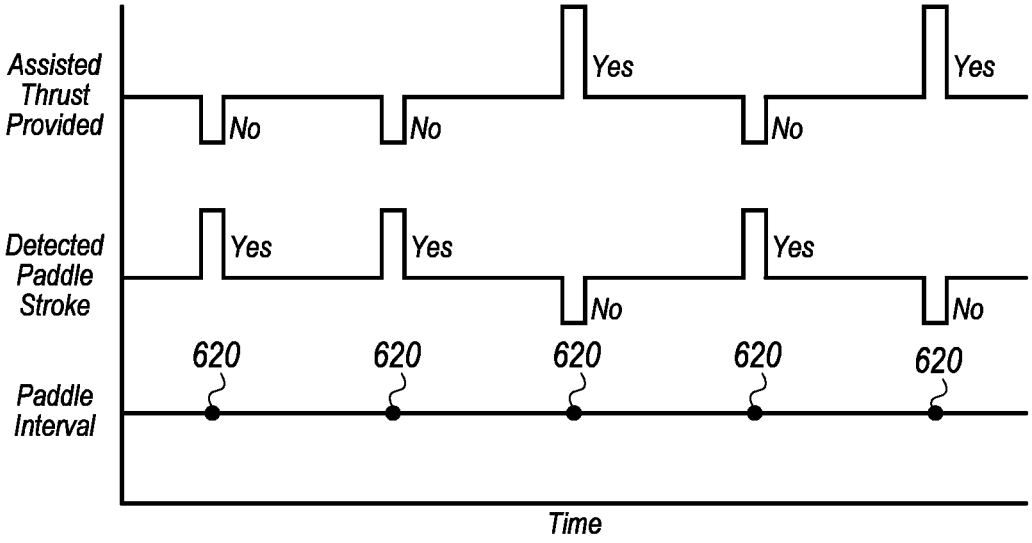
FIG. 31 depicts a plot of assisted thrust provided, paddle stroke detected, and paddle interval versus time for an embodiment of the paddle training mode.

FIG. 31 depicts a plot of assisted thrust provided, paddle stroke detected, and paddle interval versus time for an embodiment of the paddle training mode. The user sets paddle intervals 620 based on the desired pacing for the user. At each paddle interval 620, system 500 determines if a paddle stroke (forward motion event) is detected. As shown in FIG. 31, when a paddle stroke is detected ("Yes"), assisted thrust (propulsion assistance) is not provided ("No") but when a paddle stroke is not detected ("No"), assisted thrust is provided ("Yes").

Yet another embodiment of a paddle assistance mode may include providing resistance from the propulsion device during a pacing interval (e.g., a "paddle training resistance mode"). In such an embodiment, a user may set a desired pace for the user's paddle stroke and propulsion device 300 provides reverse propulsion during the paddle stroke events (e.g., at the pacing intervals) to provide resistance against the paddle stroke. In some embodiments, propulsion device 300 may provide reverse propulsion when a maximum speed rate set by the user is reached. In some embodiments, propulsion device 300 may provide reverse propulsion when a paddle stroke is detected using data from one or more sensors (e.g., during a detected forward motion event).

Figure 32:
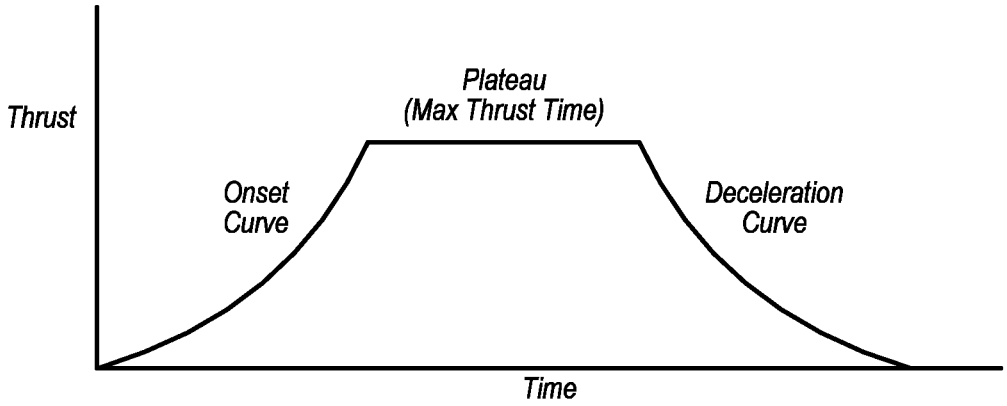
FIG. 32 depicts a plot of thrust (propulsion) versus time.

For each of the paddle assistance modes described herein, many different variables may be tuned or adjusted depending for the propulsion assistance event (e.g., after the onset of the propulsion assistance) based on a user's needed settings or selected settings. Settings that may be determined by the user include, but are not limited to, onset timing, power intensity curve, duration, maximum intensity, and after-stroke delay for the propulsion assistance provided. Changes in the settings may affect, for example, the rate of change of the propulsion (thrust), the maximum level of the propulsion, and/or the duration of the propulsion. FIG. 32 depicts a plot of thrust (propulsion) versus time. During the propulsion event, the onset curve, plateau, and/or deceleration curve may vary based on the settings to affect the shape of the thrust versus time curve.

In some embodiments, a paddle assistance mode may include an adaptive propulsion assistance mode. In some embodiments, adaptive propulsion assistance may be added to another paddle assistance mode described herein. For adaptive propulsion assistance, system 500 may receive input of one or more physiologic parameters of the user (e.g., the watercraft occupant) along with environmental conditions of the watercraft. System 500 (e.g., central control unit 502) may use one or more predetermined algorithms to determine an amount of propulsion assistance provided by propulsion device 300 based on the physiologic parameters and/or environmental conditions. Examples of physiologic parameters may include, but not be limited to, heart rate, breathing rate, SpO2 value (e.g., oxygen saturation value), and EMG (electromyography) activity. The physiologic parameters may be assessed using one or more sensors coupled to the user. Data for the physiologic parameters may be transmitted to central control unit 502 using either wired or wireless transmission techniques. In some embodiments, system 500 may determine to increase propulsion assistance provided by propulsion device 300 in response to changes in physiologic parameters such as, but not limited to, increased heart rate, increased breathing rate, decreased SpO2 value, and/or increased or decreased EMG activity.

Examples of environmental conditions that may be assessed for the adaptive propulsion assistance include, but are not limited to, wind speed and direction, water current flow, water turbulence, and/or wave action and height. Sensors positioned on propulsion device 300, mount 150, and/or hull 202 may be used to assess environmental conditions around the watercraft. Data for the environmental conditions may be transmitted to central control unit 502 using either wired or wireless transmission techniques.

System 500, as described herein, provides electronically-controlled paddle assistance for personal watercraft using a propulsion device that may be magnetically mounted to the hull of the watercraft. System 500 may be quickly and easily attached to the watercraft at any location desired, including the entry point on the body of water. As described herein, system 500 may be mounted to a variety of different watercraft using various mounts that provide universal compatibility between different watercraft. System 500 provides a flexible and customizable system that allows users to provide propulsion assistance with various types of watercraft. As such, system 500 may provide a high degree of portability, flexibility, and ease of use that allows users to explore more water regions while having the confidence to safely arrive back to shore, even when a user becomes tired or fatigued. Additionally, as described herein, system 500 may provide the ability to provide several different paddle assistance modes while utilizing a variety of sensors to provide adaptability for the different paddle assistance modes.

Figure 33:
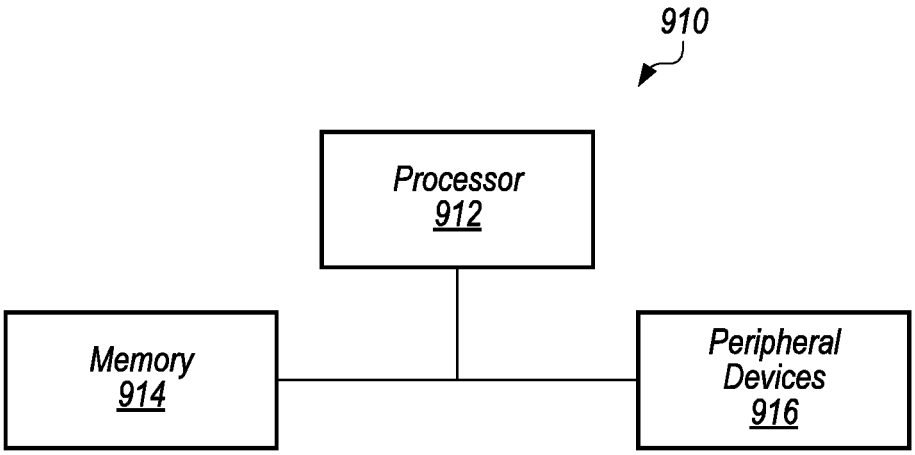
FIG. 33 depicts a block diagram of one embodiment of exemplary computer system.

FIG. 33 depicts a block diagram of one embodiment of exemplary computer system 910 that may be used with system 500. Exemplary computer system 910 may be used to implement one or more embodiments described herein. In some embodiments, computer system 910 is operable by a user to implement one or more embodiments described herein. In the embodiment of FIG. 33, computer system 910 includes processor 912, memory 914, and various peripheral devices 916. Processor 912 is coupled to memory 914 and peripheral devices 916. Processor 912 is configured to execute instructions, including the instructions for paddle assistance modes, which may be in software. In various embodiments, processor 912 may implement any desired instruction set (e.g. Intel Architecture-32 (IA-32, also known as x86), IA-32 with 64 bit extensions, x86-64, PowerPC, Sparc, MIPS, ARM, IA-64, etc.). In some embodiments, computer system 910 may include more than one processor. Moreover, processor 912 may include one or more processors or one or more processor cores.

Processor 912 may be coupled to memory 914 and peripheral devices 916 in any desired fashion. For example, in some embodiments, processor 912 may be coupled to memory 914 and/or peripheral devices 916 via various interconnect. Alternatively or in addition, one or more bridge chips may be used to coupled processor 912, memory 914, and peripheral devices 916.

Memory 914 may comprise any type of memory system. For example, memory 914 may comprise DRAM, and more particularly double data rate (DDR) SDRAM, RDRAM, etc. A memory controller may be included to interface to memory 914, and/or processor 912 may include a memory controller. Memory 914 may store the instructions to be executed by processor 912 during use, data to be operated upon by the processor during use, etc.

Figure 34:
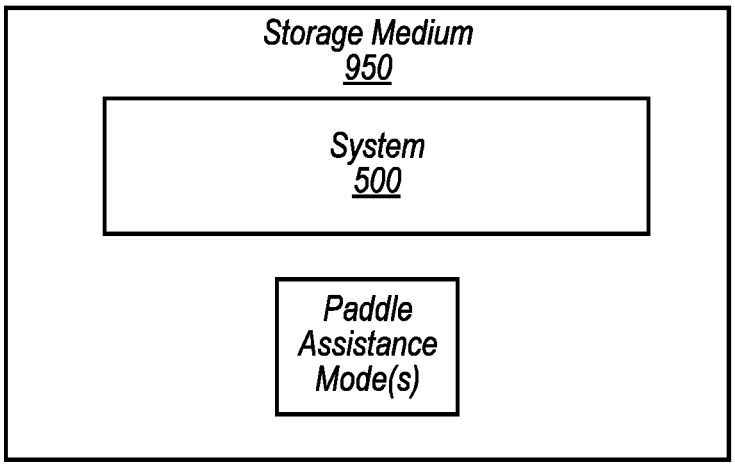
FIG. 34 depicts a block diagram of one embodiment of a computer accessible storage medium.

Peripheral devices 916 may represent any sort of hardware devices that may be included in computer system 910 or coupled thereto (e.g., storage devices, optionally including computer accessible storage medium 950, shown in FIG. 34, other input/output (I/O) devices such as video hardware, audio hardware, user interface devices, networking hardware, etc.).

Turning now to FIG. 34, a block diagram of one embodiment of computer accessible storage medium 950 including one or more data structures representative of system 500 (depicted in FIG. 26) and one or more code sequences representative of paddle assistance mode(s) described herein. Each code sequence may include one or more instructions, which when executed by a processor in a computer, implement the operations described for the corresponding code sequence. Generally speaking, a computer accessible storage medium may include any storage media accessible by a computer during use to provide instructions and/or data to the computer. For example, a computer accessible storage medium may include non-transitory storage media such as magnetic or optical media, e.g., disk (fixed or removable), tape, CD-ROM, DVD-ROM, CD-R, CD-RW, DVD-R, DVD-RW, or Blu-Ray. Storage media may further include volatile or non-volatile memory media such as RAM (e.g. synchronous dynamic RAM (SDRAM), Rambus DRAM (RDRAM), static RAM (SRAM), etc.), ROM, or Flash memory. The storage media may be physically included within the computer to which the storage media provides instructions/data. Alternatively, the storage media may be connected to the computer. For example, the storage media may be connected to the computer over a network or wireless link, such as network attached storage. The storage media may be connected through a peripheral interface such as the Universal Serial Bus (USB). Generally, computer accessible storage medium 950 may store data in a non-transitory manner, where non-transitory in this context may refer to not transmitting the instructions/data on a signal. For example, non-transitory storage may be volatile (and may lose the stored instructions/data in response to a power down) or non-volatile.

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. A mounting system for coupling a propulsion device to a watercraft, comprising:

a first mounting component configured to be attached to a hull of the watercraft, wherein the first mounting component includes one or more first magnets; and a second mounting component configured to be attached to the propulsion device with at least one fastener, wherein the second mounting component includes one or more second magnets, and wherein the second mounting component comprises a recess inside a raised outer edge, the second magnets being position in the recess;

wherein the first magnets are arranged in the first mounting component and the second magnets are arranged in the second mounting component such that the second magnets are attracted to the first magnets when the second mounting component is positioned in proximity to the first mounting component, the second mounting component thereby being coupled to the first mounting component by the attraction between the second magnets and the first magnets.

2. The mounting system of claim 1, wherein the first mounting component includes a plurality of the first magnets positioned along a centerline of the first mounting component, and wherein the second mounting component includes a plurality of the second magnets positioned along a centerline of the second mounting component.

3. The mounting system of claim 2, wherein the plurality of the first magnets and the plurality of the second magnets have predetermined magnetic polarities that position the propulsion device in a correct orientation for providing propulsion for the watercraft when the second mounting component is coupled to the first mounting component.

4. The mounting system of claim 1, wherein the first mounting component is configured to be positioned inside the recess when the second mounting component is coupled to the first mounting component.

5. The mounting system of claim 1, further comprising an elastic attachment mechanism, wherein the elastic attachment mechanism includes at least one elastic attachment component on the first mounting component and at least one elastic attachment component on the second mounting component, and wherein the elastic attachment mechanism is configured to elastically attach the second mounting component to the first mounting component.

6. The mounting system of claim 5, wherein the second mounting component is capable of moving away from the first mounting component when the second mounting component encounters a force that exceeds an attractive force between the first magnets and the second magnets, and wherein the elastic attachment mechanism returns the second mounting component to engage with the first mounting component after the force is removed.

7. A mounting system for coupling a propulsion device to a watercraft, comprising:

a first mounting component configured to be attached to a hull of the watercraft, wherein the first mounting component includes one or more first magnets; and a second mounting component configured to be attached to the propulsion device with at least one fastener, wherein the second mounting component includes one or more second magnets, wherein the second mounting component comprises a hinge, the second mounting component being configured to be attached to the propulsion device with the hinge, and wherein the propulsion device is capable of being rotated on the hinge between a deployed position and an undeployed position, the deployed position being an operating position for the propulsion device;

wherein the first magnets are arranged in the first mounting component and the second magnets are arranged in the second mounting component such that the second magnets are attracted to the first magnets when the second mounting component is positioned in proximity to the first mounting component, the second mounting component thereby being coupled to the first mounting component by the attraction between the second magnets and the first magnets.

8. The mounting system of claim 7, wherein the undeployed position of the propulsion device comprises a position where the propulsion device is rotated on the hinge to retract the propulsion device into a cavity in the hull of the watercraft.

9. The mounting system of claim 8, wherein the second mounting component includes an opening to allow the propulsion device to retract into the cavity in the hull of the watercraft.

10. The mounting system of claim 7, wherein the hinge is configured to allow the propulsion device to automatically rotate towards the deployed position when the propulsion device is turned on, and wherein the hinge is configured to automatically rotate the propulsion device towards the undeployed position when the propulsion device is turned off.

11. The mounting system of claim 7, wherein the hinge comprises a spring, the spring being configured to provide force automatically rotating the propulsion device towards the undeployed position when the propulsion device is turned off.

12. The mounting system of claim 7, further comprising an elastic tether device configured to be coupled to the propulsion device and the watercraft, wherein the elastic tether device is configured to provide force automatically rotating the propulsion device towards the undeployed position when the propulsion device is turned off.

13. The mounting system of claim 7, wherein the propulsion device is capable of being rotated on the hinge to a cleaning position between the deployed position and the undeployed position, wherein, in the cleaning position, the propulsion device is rotated perpendicular to forward motion of the watercraft, and wherein, in the cleaning position, the propulsion device is capable of operating in a reverse mode to clean debris from the propulsion device.

14. A mounting system for coupling a propulsion device to a watercraft, comprising:

a first mounting component configured to be attached to a hull of the watercraft, wherein the first mounting component includes one or more first magnets, and wherein the first mounting component comprises a recessed channel along at least a portion of a perimeter of the first mounting component; and a second mounting component configured to be attached to the propulsion device with at least one fastener, wherein the second mounting component includes one or more second magnets, wherein the second mounting component comprises a protrusion along at least a portion of a perimeter of the second mounting component, and wherein the protrusion is configured to engage the recessed channel when the second mounting component is coupled to the first mounting component;

wherein the first magnets are arranged in the first mounting component and the second magnets are arranged in the second mounting component such that the second magnets are attracted to the first magnets when the second mounting component is positioned in proximity to the first mounting component, the second mounting component thereby being coupled to the first mounting component by the attraction between the second magnets and the first magnets.

15. The mounting system of claim 14, wherein the protrusion engages the recessed channel from a rear of the first mounting component, the second mounting component thereby being held in place against the first mounting component during forward propulsion of the watercraft.

16. The mounting system of claim 15, wherein the second mounting component is configured to slide backwards using the engagement between the protrusion and the recessed channel when the propulsion device is contacted by an obstruction during forward propulsion of the watercraft.

* * * * *